US007359657B2

(12) United States Patent
Kikuchi et al.

(10) Patent No.: US 7,359,657 B2
(45) Date of Patent: Apr. 15, 2008

(54) METHOD AND APPARATUS FOR IMAGE FORMING CAPABLE OF EFFECTIVELY REPLACING A FACING MECHANISM USED IN THE IMAGE FORMING

(75) Inventors: Nobuo Kikuchi, Kawagoe (JP); Satoshi Hatori, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 11/169,700

(22) Filed: Jun. 30, 2005

(65) Prior Publication Data

US 2006/0002736 A1 Jan. 5, 2006

(30) Foreign Application Priority Data

Jun. 30, 2004 (JP) ..... 2004-195075

(51) Int. Cl.
*G03G 21/18* (2006.01)

(52) U.S. Cl. ..... 399/113; 399/123

(58) Field of Classification Search ..... 399/110, 399/111, 113, 123, 349, 357
See application file for complete search history.

(56) References Cited

U.S. PATENT DOCUMENTS 3,879,124 A * 4/1975 Eppe et al. ..... 399/353
4,708,455 A * 11/1987 Kubota et al. ..... 399/111
4,952,989 A * 8/1990 Kawano et al. ..... 399/113
5,289,234 A * 2/1994 Asano et al. ..... 399/113
5,583,618 A * 12/1996 Takeuchi et al. ..... 399/111
6,832,061 B2 * 12/2004 Saito et al. ..... 399/111
6,836,639 B2 * 12/2004 Karakama et al. ..... 399/351
7,110,696 B2 * 9/2006 Murakami et al. ..... 399/101
2005/0169663 A1 8/2005 Shintani et al.

FOREIGN PATENT DOCUMENTS

JP 60198575 A * 10/1985
JP 01-142666 6/1989
JP 02028685 A * 1/1990
JP 2002189347 A * 7/2002

* cited by examiner

*Primary Examiner*—Robert Beatty
(74) *Attorney, Agent, or Firm*—Oblon, Spivak, McClelland, Maier & Neustadt, P.C.

(57) ABSTRACT

A process cartridge detachably attached to an image forming apparatus includes a first body member, a second body member including an engaging part, in which the second body member is engaged with the first body member by the engaging part and pivotably moves between an open position and a closed position, an image bearing member detachably disposed in the first body member and configured to bear an image on a surface thereof, and a facing mechanism detachably disposed in one of the first body member or the second body member, and arranged around the image bearing member to face the image bearing member.

28 Claims, 21 Drawing Sheets

METHOD AND APPARATUS FOR IMAGE FORMING CAPABLE OF EFFECTIVELY REPLACING A FACING MECHANISM USED IN THE IMAGE FORMING

CROSS-REFERENCE TO RELATED APPLICATIONS

The present application claims priority to Japanese patent application no. 2004-195075, filed in the Japan Patent Office on Jun. 30, 2004, the disclosure of which is incorporated by reference herein in its entirety.

BACKGROUND OF THE INVENTION

1. Field of the Invention

The present invention relates to a method and apparatus for image forming, and more particularly relates to a method and apparatus for image forming capable of effectively replacing a facing mechanism used in the image forming performed by the method and apparatus.

2. Discussion of the Background

A process cartridge included in an image forming apparatus has been in wide use. The process cartridge generally includes an image bearing member and at least one unit or process unit performing image forming operations with the image bearing member, and is detachable with respect to a main body of the image forming apparatus. For example, the process unit includes a charging unit, a developing unit, a transfer unit, a cleaning unit, etc.

In a process cartridge, a first frame body and a second frame body which is rotatably attached to the first frame body and can be revolved between open and closed positions. An image bearing member is mounted to the first frame body, and a facing unit or process unit is mounted to the second frame body. When the second frame body is revolved to the open position, the image bearing member is separated from the process unit so that the image bearing member can easily be unloaded from the process-cartridge and be loaded to the process cartridge.

However, it may be difficult to replace the process unit from the process cartridge. Therefore, it is desirable to easily replace the process unit as well as the image bearing member.

SUMMARY OF THE INVENTION

The present invention has been made in view of the above-mentioned circumstances.

An object of the present invention is to provide a novel process cartridge capable of effectively replacing facing mechanisms disposed therein.

Another object of the present invention is to provide a novel method of removing facing mechanisms disposed in the above-described novel process cartridge.

Another object of the present invention is to provide a novel image forming apparatus including the above-described novel process cartridge.

In one embodiment, a novel process cartridge detachably attached to an image forming apparatus includes a first body member, a second body member, an image bearing member, and a facing mechanism. The second body member includes an engaging part, is engaged with the first body member by the engaging part, and pivotably moves between an open position and a closed position. The image bearing member is detachably disposed in the first body member and is configured to bear an image on a surface thereof. The facing mechanism is detachably disposed in one of the first body member or the second body member, is arranged around the image bearing member to face the image bearing member.

Further, in one embodiment, a novel method of removing facing mechanisms of an image forming apparatus includes keeping first and second body members engaged with each other by an engaging part to form a closed position, opening a lid provided on a top of the second body member over a cleaning mechanism, removing a cleaning unit from the cleaning mechanism via an open space formed by opening the lid, and removing an auxiliary unit from the cleaning mechanism via the open space, in which the auxiliary unit disposed at a position lower than the cleaning unit.

Further, in one embodiment, a novel image forming apparatus includes a frame and a process cartridge. The process cartridge is detachably disposed in the image forming apparatus and includes a first body member, a second body member, an image bearing member, and a facing mechanism. The second body member includes an engaging part, and is engaged with the first body member by the engaging part, and pivotably moves between an open position and a closed position. The image bearing member is detachably disposed in the first body member and is configured to bear an image on a surface thereof. The facing mechanism is detachably disposed in one of the first body member or the second body member, and is arranged around the image bearing member to face the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
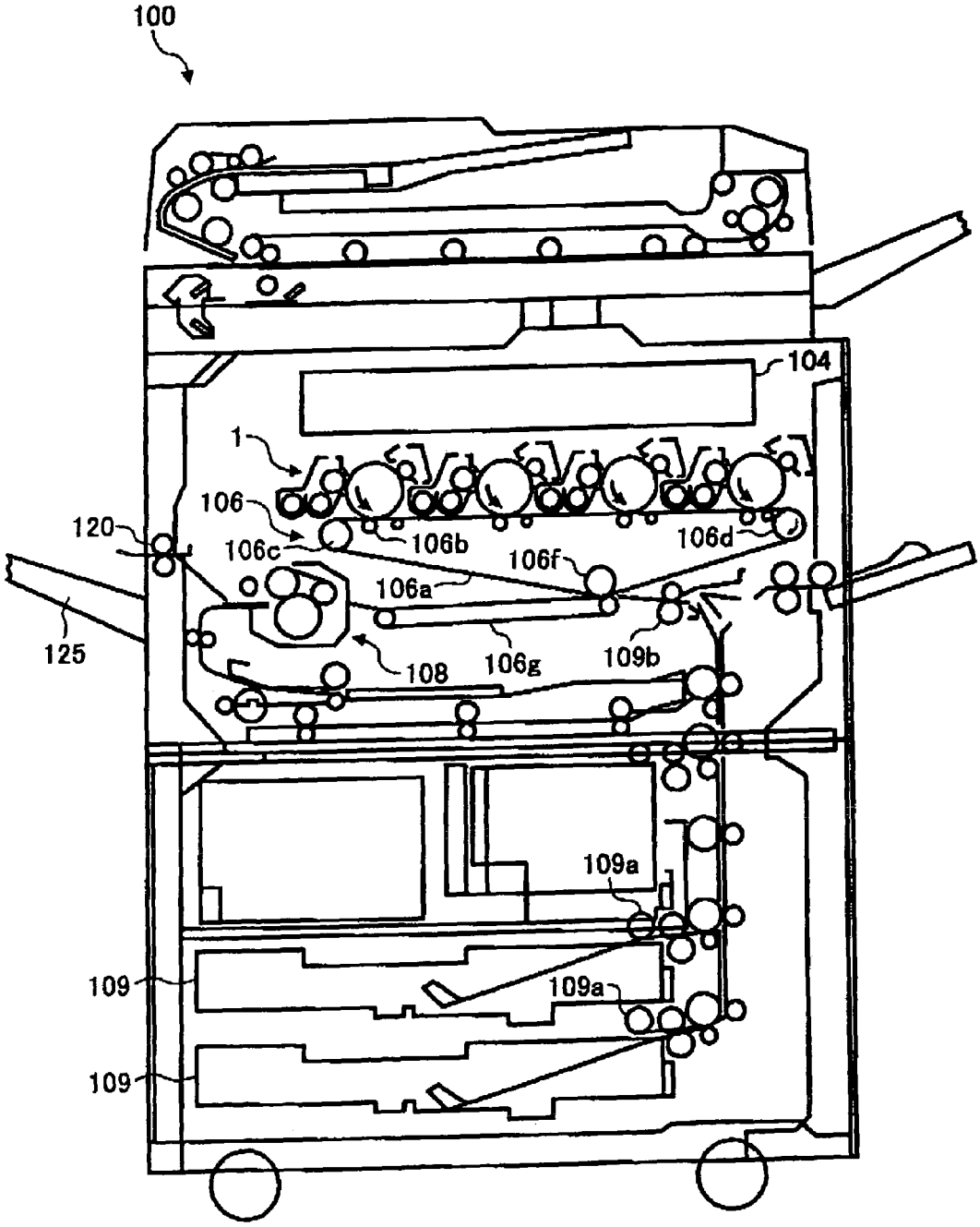
FIG. 1 is a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of an image forming apparatus 100 is shown as one example of an image forming apparatus according to an exemplary embodiment of the present invention. Although the image forming apparatus 100 of FIG. 1 is a tandem type using the technique to form a full color image with toners of four different colors, such as magenta (m), cyan (c), yellow (y) and black (bk), the image forming apparatus 100 can be a monochromatic printer, a copier, a facsimile machine and other image forming apparatus.

The image forming apparatus 100 can include four process cartridges 1, an optical writing device 104 as a writing mechanism, an image transfer device 106 as a transfer mechanism, a fixing device 108 as a fixing mechanism, and sheet feeding cassettes 109 as a sheet feeding mechanism.

Each of the four process cartridges 1 includes an image bearing member, a charging mechanism, a developing mechanism, and/or a cleaning mechanism. The four process cartridges 1 can have similar structures and functions, except that the toners are different colors to form magenta images, cyan images, yellow images and black images, respectively. The four process cartridges 1 performs an image forming operation to form toner images based on respective electrostatic latent images on respective image bearing members. Details of the four process cartridges 1 will be described later.

The optical writing device 104 is provided at a position above the four process cartridges 1. The optical writing device 104 irradiates the respective image bearing members included in the four process cartridges 1 with respective imagewise laser light beams so that the electrostatic latent images can be formed on respective surfaces of the image bearing members.

The image transfer device 106 includes an intermediate transfer belt 106*a*, primary transfer rollers 106*b*, supporting rollers 106*c* and 106*d*, a secondary transfer roller 106*f*, and a sheet conveying belt 106*g*.

The intermediate transfer belt 106*a* is located or disposed below the process cartridges 1 (substantially at the center of the image forming apparatus 100). The intermediate transfer belt 106*a* forming an endless belt is passed over or surrounds the supporting rollers 106*c* and 106*d*, and the secondary transfer roller 106*f*. The intermediate transfer belt 106*a* is held in contact with the image bearing members and travels in a same direction as the image bearing members rotate.

The primary transfer rollers 106*b* are disposed inside a loop of the intermediate transfer belt 106*a* to face the respective image bearing members, which are accommodated in the four process cartridges 1.

The sheet conveying belt 106*g* electrically attracts a recording sheet (or a recording medium) so that a full color toner image formed on the intermediate transfer belt 106*a* in an overlaying manner can be transferred onto the recording sheet.

The fixing device 108 fixes the full color toner image formed on the recording sheet by applying heat and pressure.

The sheet feeding cassettes 109 are arranged in a lower portion of the image forming apparatus 100, and are loaded with a stack of sheets of particular size including the recording sheet. The sheet feeding cassettes 109 include respective pickup rollers 109*a*. When an image forming operation is performed, the recording sheet is fed from one of the sheet feeding cassettes 109 by a corresponding one of the pickup rollers 109*a*, and is conveyed toward a pair of registration rollers 109*b*.

A full-color image forming operation of the image forming apparatus 100 is now described.

When the image forming apparatus 100 receives full color image data, the writing device 104 irradiates the respective image bearing members included in the process cartridges 1 with the laser light beams corresponding to the respective color image data. The process cartridges 1 form respective electrostatic latent images, which correspond to the respective color image data, on respective surfaces of the image bearing members. The process cartridges 1 then generate the respective electrostatic latent images as toner images such as magenta, cyan, yellow and black toner images on the respective image bearing members.

The recording sheet is fed from one of the sheet feeding cassettes 109. An image transferring area formed between the respective image bearing members and the intermediate transfer belt 106*a* of the image transfer device 106 pressed by the respective primary transfer rollers 106*b*. The recording sheet is fed into the image transferring area in synchronization with the pair of registration rollers 109*b*.

The respective toner images formed on the respective surfaces of the image bearing members are transferred onto a surface of the intermediate transfer belt 106*a* in an overlaying manner by electrostatic transfer provided by the primary transfer rollers 106*b* so that a full color toner image can be formed.

The recording sheet is electrostatically attracted by the surface of the sheet conveying belt 1069. The recording sheet is fed while the recording sheet is attracted by the sheet transporting belt 1069, and the full color toner image formed on the surface of the intermediate transfer belt 106*a* is transferred onto the recording sheet.

The recording sheet is conveyed by the sheet conveying belt 106*g*, and a positive polarity bias is applied to the secondary transfer roller 106*f* when transferring the full color toner image on the intermediate transfer belt 106*a* onto the recording medium conveyed by the sheet conveying belt 106*g*. As a result, the full color toner image formed by each of the process cartridges 1 is successively and electrostatically transferred from the intermediate transfer belt 106*a* onto the recording sheet.

The full color toner image on the recording sheet is fixed by the fixing device 108 through the application of heat and pressure. The recording sheet having the fixed full color image is discharged to a sheet discharging tray 125 after passing through a pair of sheet discharging rollers 120.

A belt cleaning unit may be provided in a periphery of the intermediate transfer belt 106*a* to remove residual toner on the surface of the intermediate transfer belt 106*a*.

Figure 2:
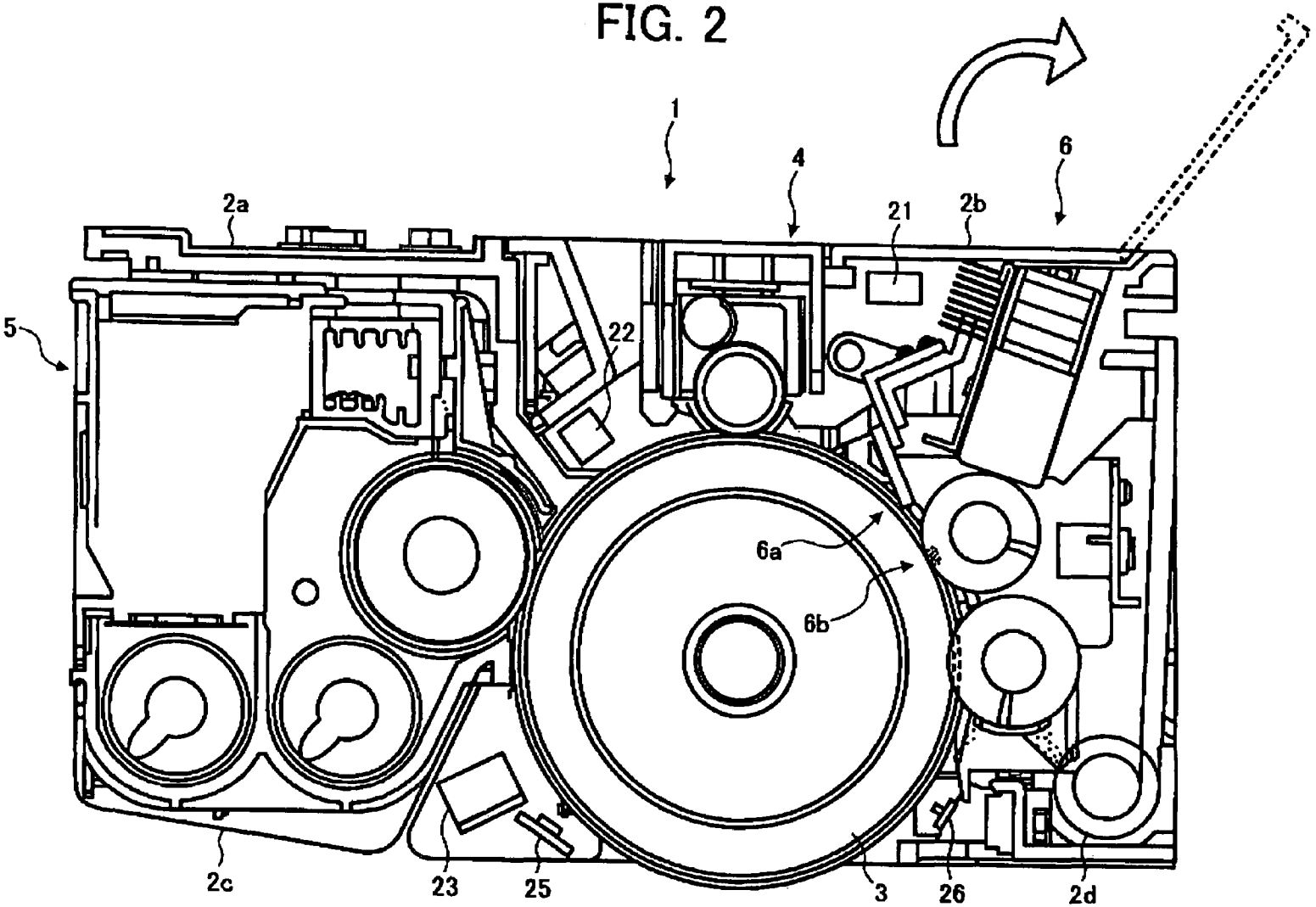
FIG. 2 is a cross sectional view of a process cartridge included in the image forming apparatus of FIG. 1.
Figure 3:
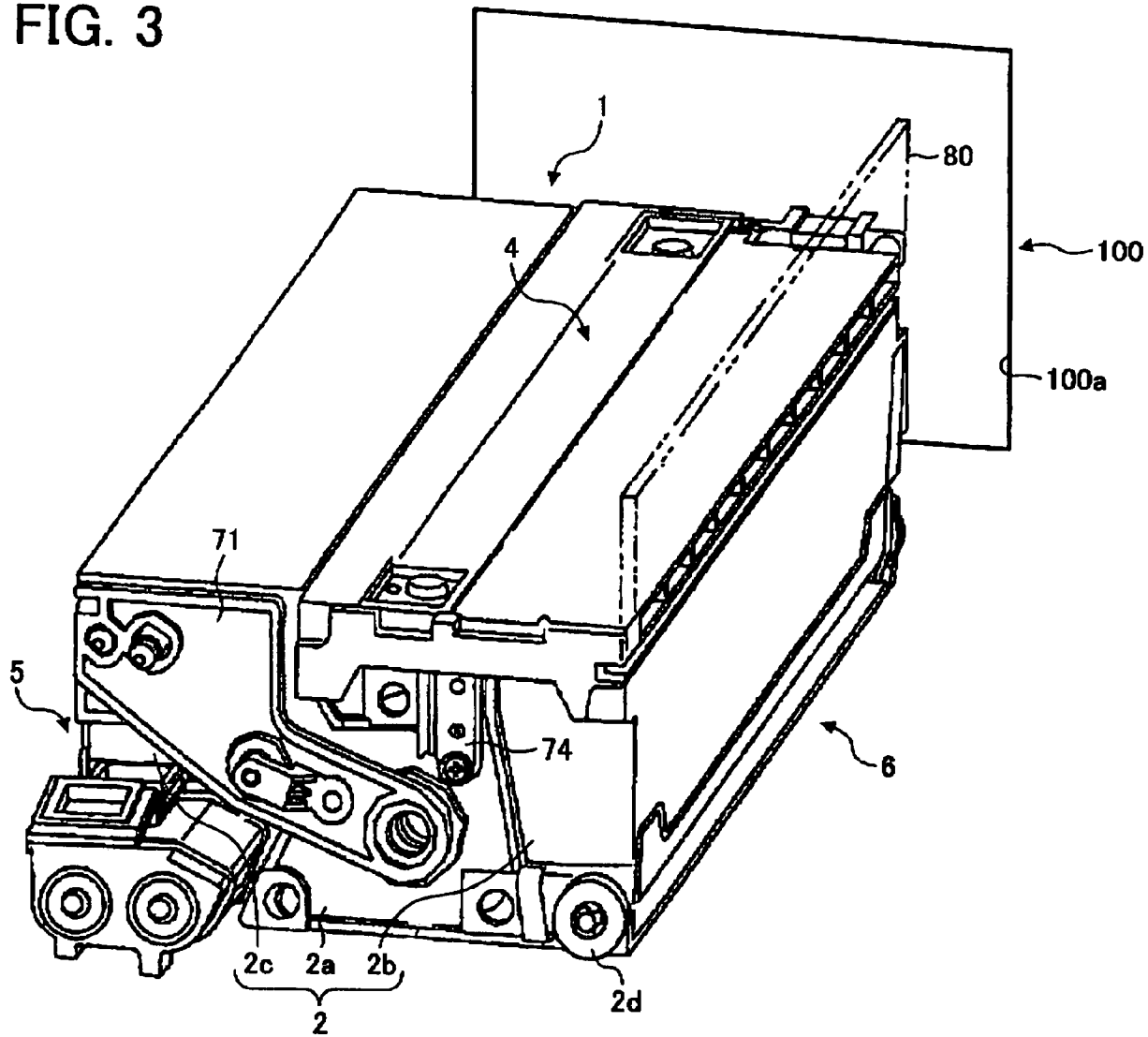
FIG. 3 is a perspective view of the process cartridge of FIG. 2.

Referring to FIGS. 2 and 3, a schematic structure of one of the four process cartridges 1 according to the present invention is described. As previously described, the four process cartridges 1 have similar structures and functions to each other, except toner colors. Therefore, the discussion below will be given focusing on one process cartridge that is hereinafter referred to as a process cartridge 1.

As shown in FIGS. 2 and 3, the process cartridge 1 includes the process cartridge frame body 2 (see FIG. 3) that can accommodate an image bearing member, the charging mechanism, the developing mechanism, and/or the cleaning mechanism, which are provided as a process device or a facing mechanism, as previously described. For example, the image bearing member may be formed by a photoconductive element 3, the charging mechanism may be formed by a charging module 4, the developing mechanism may be formed by a developing module 5, and the cleaning mechanism may be formed by a cleaning module 6.

The process cartridge frame body 2 includes a first frame body or first body member 2*a*, a second frame body or second body member 2*b*, and a third frame body or third body member 2*c*.

The first frame body 2*a* has a receiving portion for accommodating the photoconductive element 3.

The second frame body 2*b* accommodates the cleaning module 6. The second frame body 2*b* includes an engaging part 2*d* for pivotably attaching the second frame body 2*b* to the first frame body 2*a*, and a frame body positioning member 74 for positioning the second frame body 2*b*. The second frame body 2*b* further includes a lid 80, which will be described later.

The third frame body 2*c* accommodates the developing module 5. The third frame body 2*c* includes a frame body positioning member 71 for attaching and positioning the third frame body 2*c* to the first frame body 2*a*.

The process cartridge frame body 2 can further include a temperature and humidity sensor 21, a potential sensor 22, a toner density sensor 23, a pretransfer discharge unit 25, and a precleaning discharge unit 26, which will be described later.

The photoconductive element 3 receives a light laser beam emitted by the optical writing device 104, such that an, electrostatic latent image can be formed on a surface of the photoconductive element 3.

Figure 11:
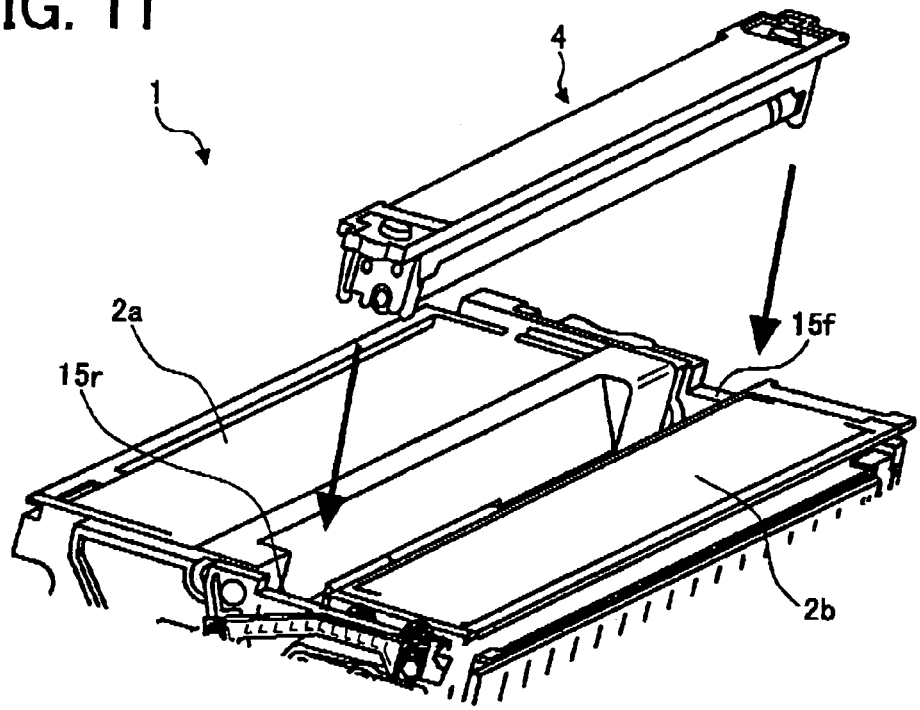
FIG. 11 is a perspective view showing the charging module loaded in the process cartridge.

The charging module 4 is designed to be vertically detachable from the second frame body 2*b* of the process cartridge 1 (see FIG. 11). The charging module 4 uniformly charges the surface of the photoconductive element 3 before the optical writing device 104 irradiates the surface of the photoconductive element 3.

The developing module 5 develops a toner image based on the electrostatic latent image formed on the surface of the photoconductive element 3.

The cleaning module 6 removes residual toner on the surface of the photoconductive element 3 after the toner image is transferred onto the surface of the intermediate transfer belt 106*a*. The cleaning module 6 includes a cleaning unit 6*a* and a coating unit 6*b*, which will be described in detail later.

As shown in FIG. 3, the process cartridge 1 itself is replaceable with respect to a main body of the image forming apparatus 100 through an opening 100*a* of the image forming apparatus 100 in an axial direction of the photoconductive element 3.

In addition, when the process cartridge 1 is removed from the main body of the image forming apparatus 100, each of the photoconductive element 3, the charging module 4, the developing module 5, and the cleaning module 6 may be replaced by a new body or module. In addition, each module may be handled independently by a service person or a user.

Figure 4A:
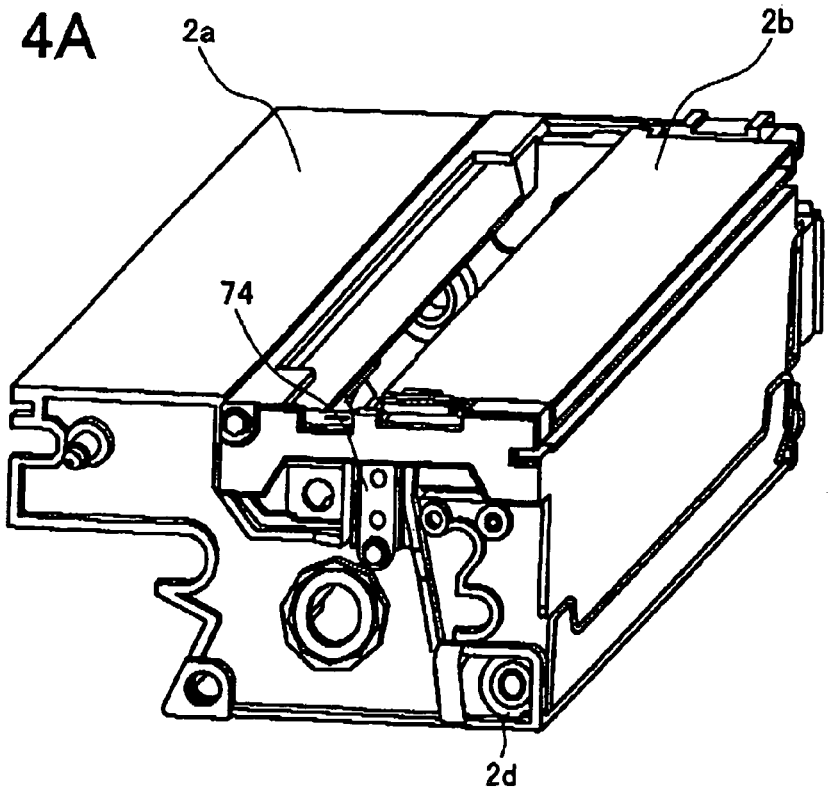
FIGS. 4A and 4B are front and rear perspective views of the process cartridge of FIG. 2.
Figure 4B:
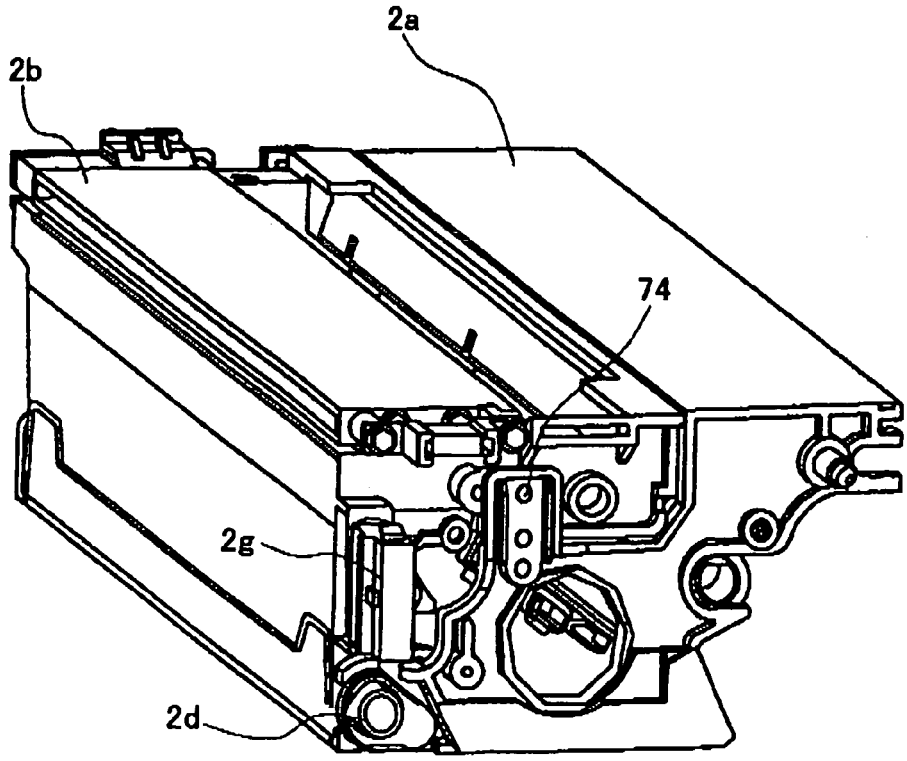

Referring to FIGS. 4A and 4B, a detailed structure of the process cartridge frame body 2 is described. FIG. 4A is a front view of the process cartridge 1, and FIG. 4B is a rear view of the process cartridge 1.

As described above, the process cartridge frame body 2 includes the first frame body 2*a* and the second frame body 2*b* connected in a pivotable manner about the engaging part 2*d* which forms a rotary axis, between an open position and a closed position. In the closed position, the first and second frame bodies 2*a* and 2*b* surround the photoconductive element 3 so that the photoconductive element 3 cannot be removed. Projecting portions and hole portions (not shown) are provided in the first and second frame bodies 2*a* and 2*b*, the projecting portions inserted through the corresponding hole portions. The engaging part 2*d* holds the projecting portion by a ring to prevent the projecting portion from slipping out of the hole portion.

One or more pins (e.g., two pins) penetrate the frame body positioning member 74 with respect to an opening that is provided at a location where the first and second frame bodies 2*a* and 2*b* overlap in the closed position, to simultaneously position and fix the first and second frame bodies 2*a* and 2*b*. Accordingly, the process cartridge frame body 2 can be assembled from the first and second frame bodies 2*a* and 2*b* which are separate from one another, without having to integrally form the process cartridge frame body 2, and the first and second frame bodies 2*a* and 2*b* can easily be separated. For this reason, the photoconductive element 3 and each process device or unit can be replaced independently. In this particular case, the first and second frame bodies 2*a* and 2*b* are pivotable about the engaging part 2*d* which forms the rotary axis, but the first and second frame bodies 2*a* and 2*b* are not limited to this structure.

The process cartridge frame body 2 may be provided with one or more detecting devices or units, as shown in FIG. 2. As previously described, the detecting device or unit may include the temperature and humidity sensor 21 for detecting a temperature and a humidity within the process cartridge 1, the potential, sensor 22 for detecting an electric potential of the photoconductive element 3, and/or the toner density sensor 23 for detecting an amount of toner developed on the photoconductive element 3 after developing. By disposing the various sensors related to the photoconductive element 3 on the first frame body 2*a* or the second frame body 2*b*, it becomes possible to easily replace each process device or unit of the process cartridge 1. In addition, it is possible to provide process devices or units that are replaceable and inexpensive.

The signal lines (or wiring harnesses) are gathered at a rear side of the process cartridge 1, and collectively connected to a connector part 2*g* which is provided on the rear side of the process cartridge 1. The connector part 2*g* connects to a connector part of the main body of the image forming apparatus 100, to be electrically connected to an electrical circuit within the main body of the image forming apparatus 100. The signal lines (or wiring harnesses) reach the connector part 2*g* by being routed along the engaging part 2*d* which forms the rotary axis. Accordingly, the first and second frame bodies 2*a* and 2*b* of the process cartridge frame body 2 can pivot (or turn) freely, to thereby improve the replaceability of each process device or unit.

As previously described, the pretransfer discharge unit 25 and/or the precleaning discharge unit 26 can also be provided.

Referring to FIGS. 5 through 8, a schematic structure of the photoconductive element 3 included in the process cartridge 1 attaching to the image forming apparatus 100 is described.

Figure 5:
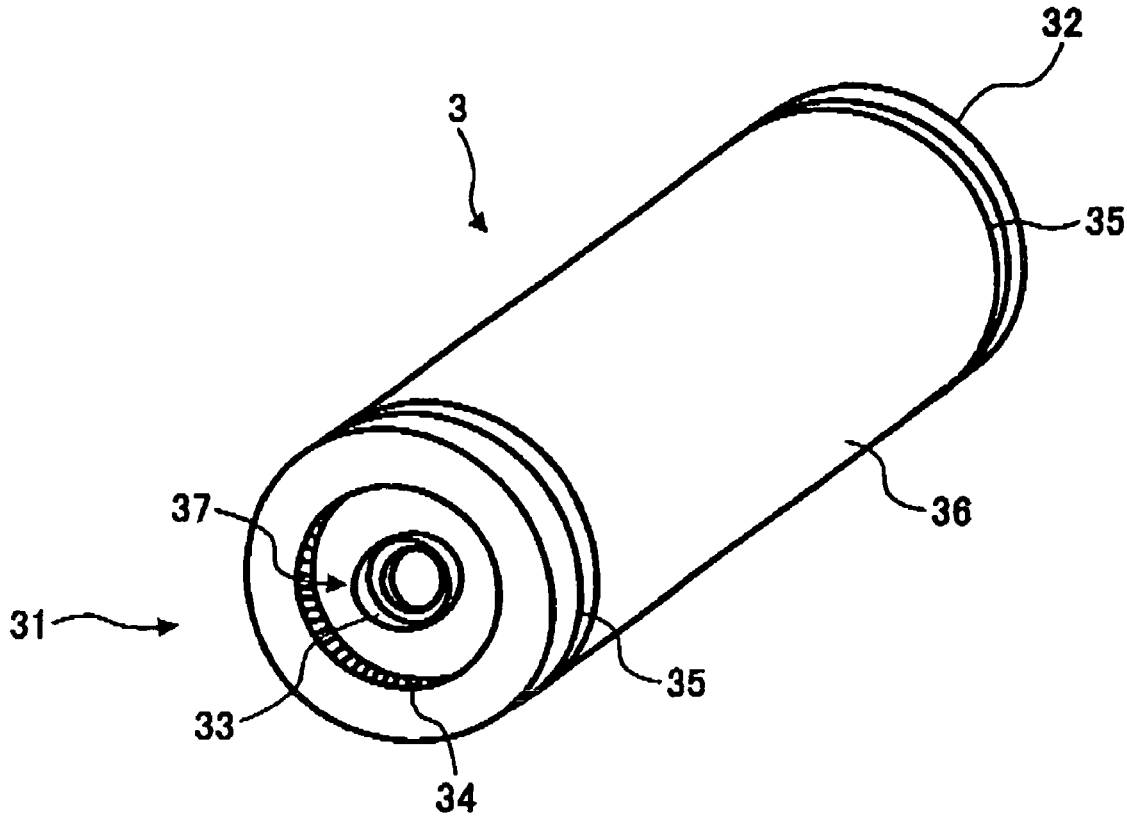
FIG. 5 is a perspective view of a photoconductive element included in the process cartridge of FIG. 2.
Figure 6:
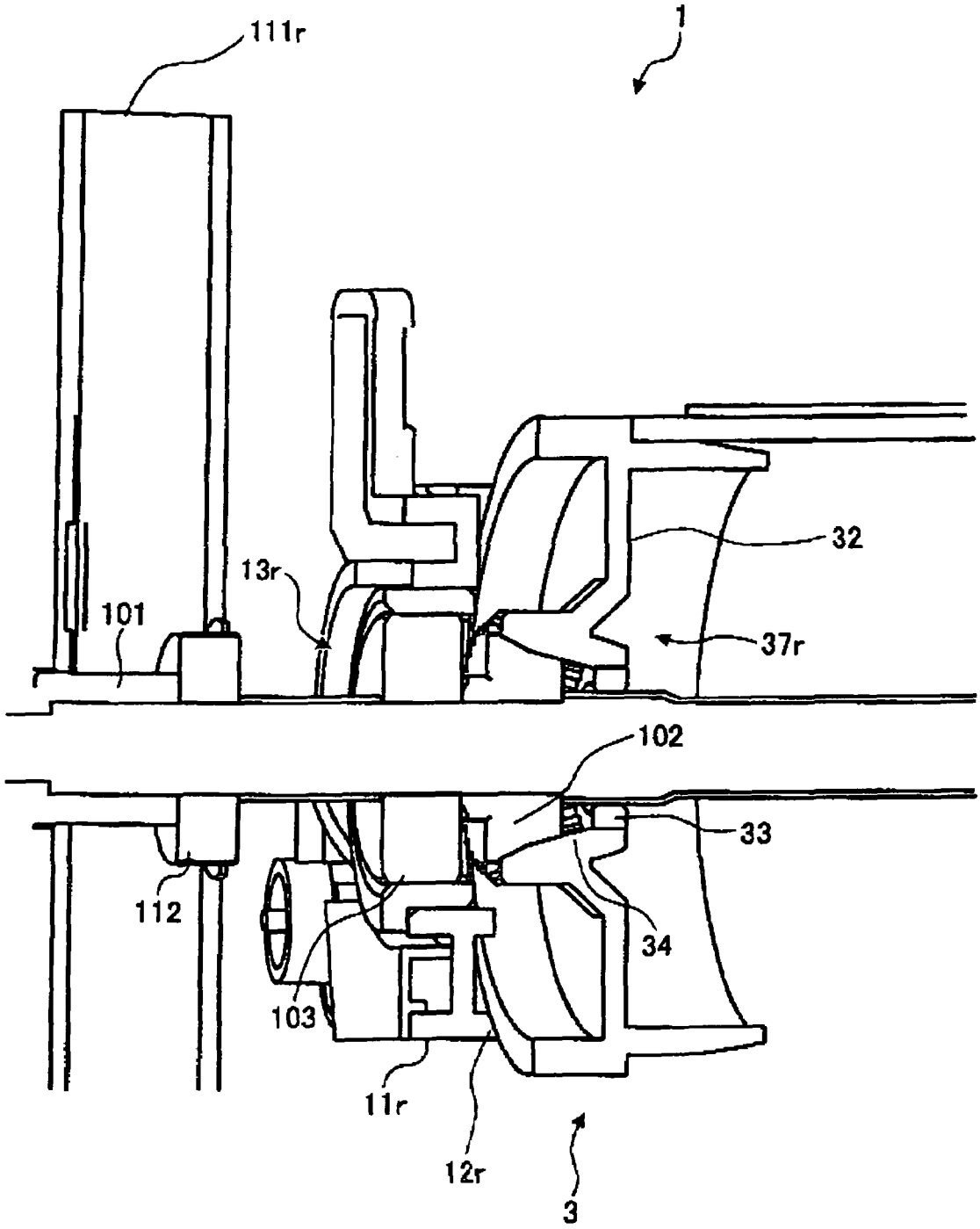
FIG. 6 is a cross sectional view of a rear side of the process cartridge of FIG. 2 mounted in the image forming apparatus of FIG. 1.
Figure 7:
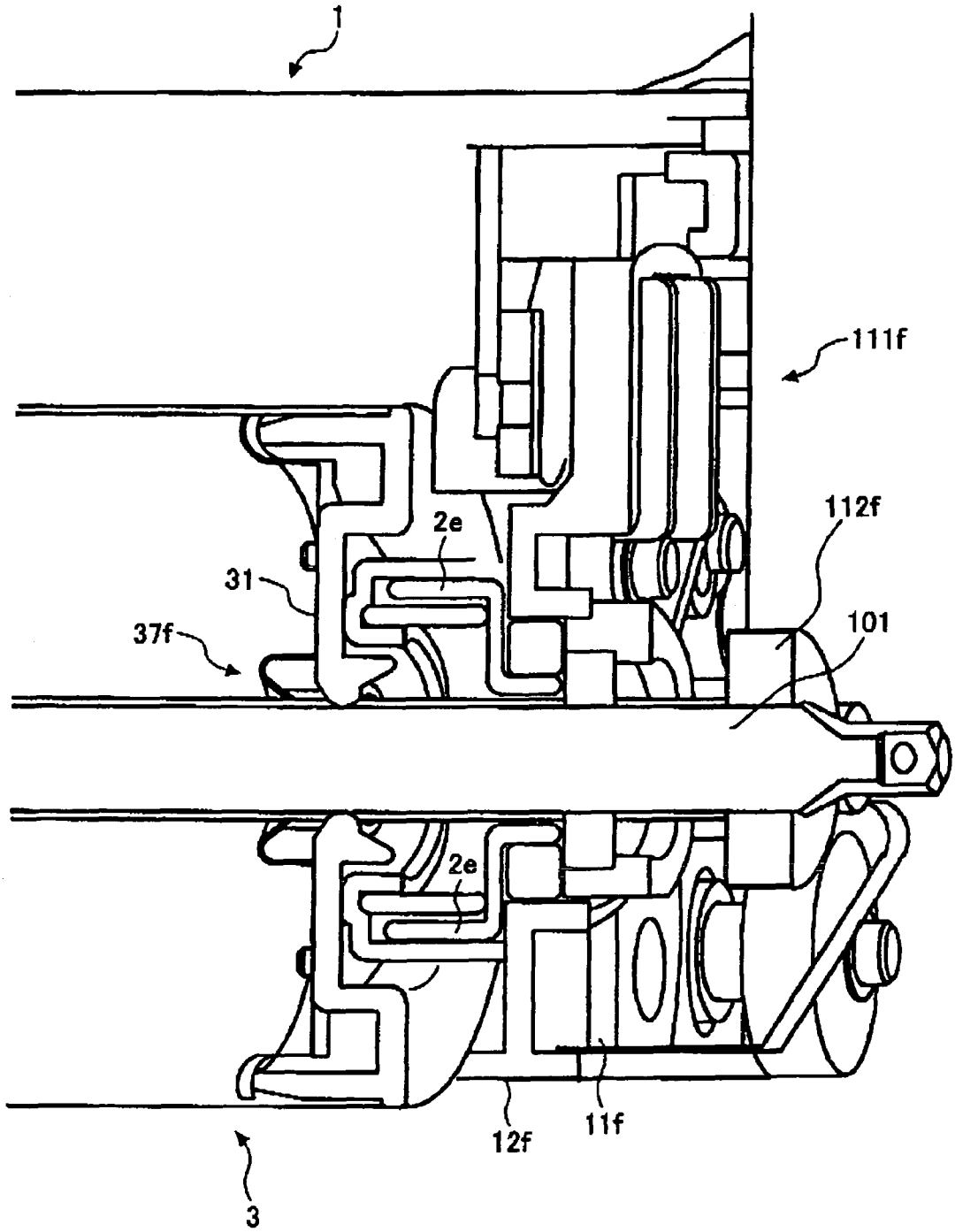
FIG. 7 is a cross sectional view of a front side of the process cartridge of FIG. 2 mounted in the image forming apparatus of FIG. 1.
Figure 8:
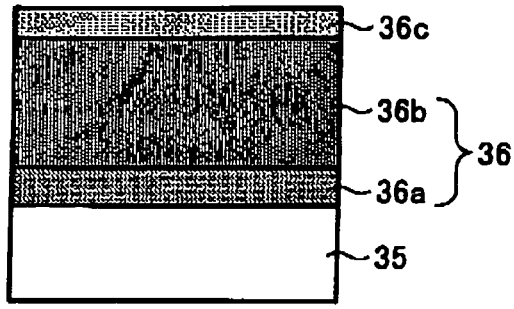
FIG. 8 is a cross sectional view of photoconductive layers of the photoconductive element of FIG. 5.

FIG. 5 is a perspective view of the photoconductive element 3. FIG. 6 is a cross sectional view of a rear side of the process cartridge 1 mounted on the image forming apparatus 100. FIG. 7 is a cross sectional view of a front side of the process cartridge 1 mounted on the image forming apparatus 100. FIG. 8 is a cross sectional view of photoconductive layers of the photoconductive element 3.

As shown in FIG. 5, the photoconductive element 3 includes a photoconductive layer 6 on a cylindrical aluminum substrate 35. When the photoconductive element 3 has a cylindrical shape, flanges 31 and 32 are provided on both ends on an inner portion of the cylinder. The photoconductive element 3 can further include a bearing 33, gears 34, and an engaging part 37, which will be described latex.

As shown in FIGS. 6 and 7, a central part of the flange 32 on the rear side of the process cartridge 1 is formed with the bearing 33 for receiving a driving shaft 101 that is provided in the main body of the image forming apparatus 100. The gears 34 are formed on an inner surface of the bearing 33, and the gears 34 mesh with gears 102 provided on the driving shaft 101.

A central part of the flange 31 on the front side of the process cartridge 1 is formed with an engaging part 37*f*, as shown in FIG. 7. When loading the photoconductive element 3 into the process cartridge 1, the engaging part 37*f* engages a positioning part 2*e* that is mounted on the first frame body 2*a*. The positioning part 2*e* is pressed by a spring (not shown) in a direction to push back the photoconductive element 3. The photoconductive element 3 may be loaded into the process cartridge 1 by loading the photoconductive element 3 into the process cartridge frame body 2 while pushing an engaging part 37*r* of the flange 32 against the positioning part 2*e*, and the photoconductive element 3 can be removed (or unloaded) from the process cartridge 1 in a reverse order. When the photoconductive element 3 is simply supported by a supporting part 12, or a front supporting part 12*f* on the front side and a rear supporting part 12*r* on the rear side, that is provided on a side plate 11, or a front side plate 11*f* on the front side and a rear side plate 11*r* on the rear side, of the process cartridge frame body 2, the positioning of the photoconductive element is not highly accurate such that the image formation may be carried out in this state. The image forming apparatus 100 has the driving shaft 101 supported by a bearing 112 including a bearing 112*f* on a side plate 111 including a rear side plate 11*r* and a front side plate 111*f* of the main body of the image forming apparatus 100. The driving shaft 101 includes a bearing 103 on the rear side plate 111*r* of the main body of the image forming apparatus 100, to cooperate with a hole 13*r* provided in a rear side plate 11*r* of the process cartridge frame body 2 of the process cartridge 1. The driving shaft 101 fits into the hole 13*r* of the process cartridge 1, to position the image forming apparatus 100 and the process cartridge 1.

Further, the driving shaft 101 is inserted into the bearing 33 of the flange 31 of the photoconductive element 3, and the gears 102 of the driving shaft 101 mesh with the gears 34 of the flange 31. When the driving shaft 101 provided in the main body of the image forming apparatus 100 is rotated, the gears 102 of the driving shaft 101 rotate the photoconductive element 3 via the gears 34 of the photoconductive element 3. In addition, the photoconductive element 3 is not fixed on the supporting part 12*r* of the process cartridge 1, and is solely supported by the supporting part 12*r*. The photoconductive element 3 is positioned by fitting the driving shaft 101 of the image forming apparatus 100 into the photoconductive element 3. The driving shaft 101 of the image forming apparatus 100 also simultaneously positions the process cartridge 1 and the photoconductive element 3. In order to drive the photoconductive element 3 with a high accuracy, it is effective to support a rotary shaft of the photoconductive element 3. However, in this embodiment, the driving shaft 101 is provided in the main body of the image forming apparatus 100, and the driving shaft 101 penetrates and positions the process cartridge 1. Consequently, it is possible to make the photoconductive element 3 and the process cartridge 1 inexpensive, and also to rotationally drive the photoconductive element 3 and the process cartridge 1 with a high accuracy.

As shown in FIG. 8, the photoconductive layers of the photoconductive element 3 include a substrate 35, a conductive layer 36, and a protection layer 36*c*.

The substrate 35 of the photoconductive element 3 can be formed from a metal, such as aluminum, copper, and/or steel, and/or alloys of these metals. The substrate 35 is formed into a generally cylindrical pipe shape by subjecting the metal or metal alloy to a process such as extruding and/or drawing, and is then subjected to a surface processing such as cutting, superfinishing, and/or polishing to form a cylindrical drum.

The photoconductive layer 36 is formed by a charge generating layer 36*a*, which has a charge generating material as a main component, and a charge transfer layer 36*b* which transfers the generated charge to the surface of the photoconductive element 3 or the substrate 35.

The protection layer 36*c* may be provided on the photoconductive layer 36 to protect the photoconductive layer 36. A filler may be added to the protection layer 36*c* for the purposes of improving the wear (or abrasion) resistance.

Referring to FIGS. 9A to 12, a structure of the charging module 4 is described.

Figure 9A:
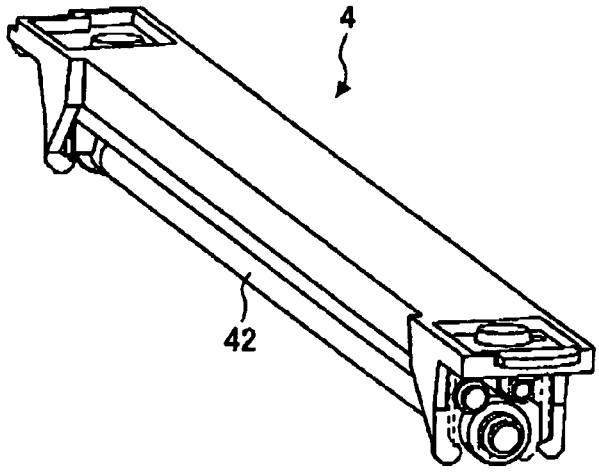
FIGS. 9A and 9B are perspective and side views showing a charging module included in the process cartridge.
Figure 9B:
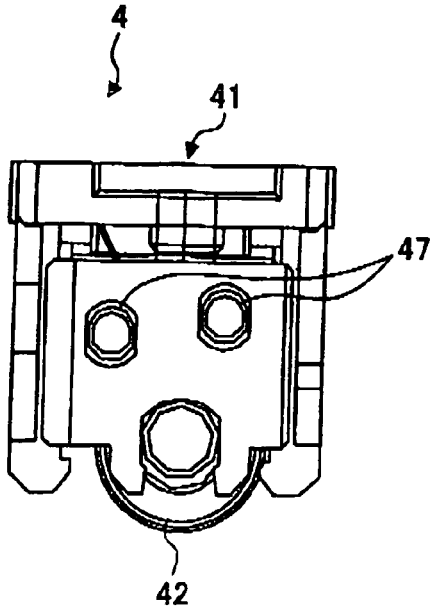
Figure 10:
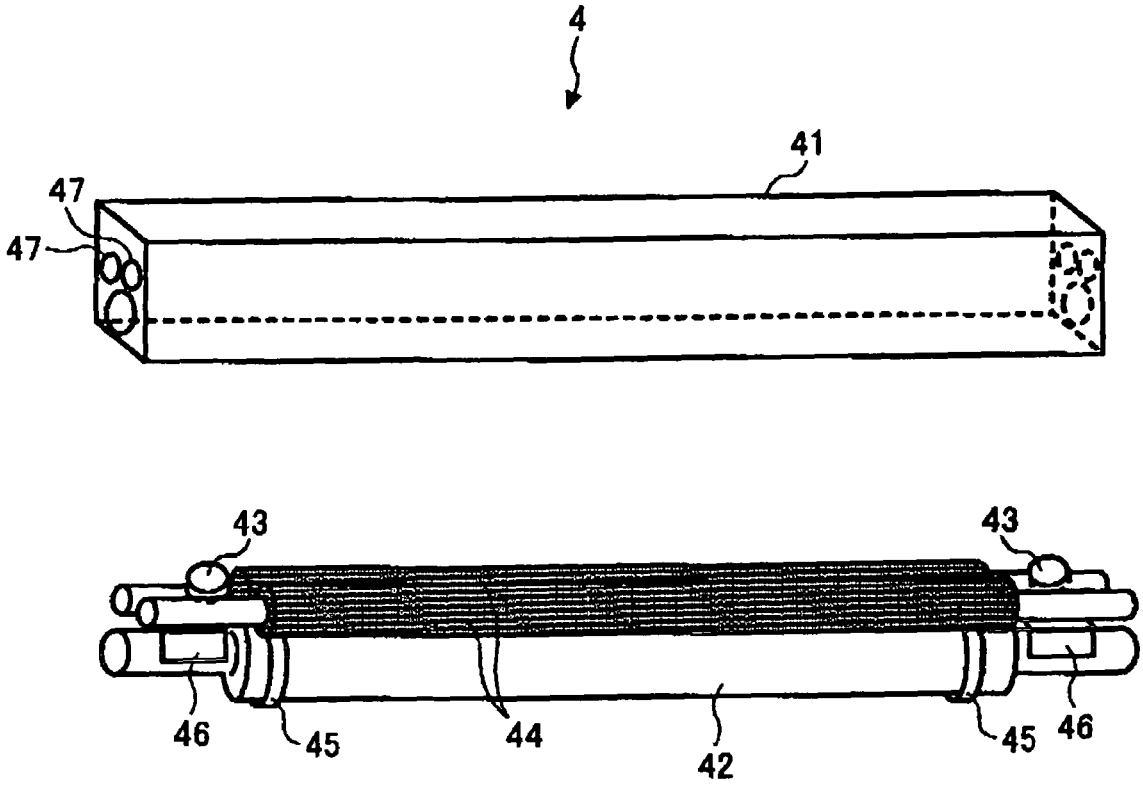
FIG. 10 is a perspective view of the charging module of FIGS. 9A and 9B.
Figure 12:
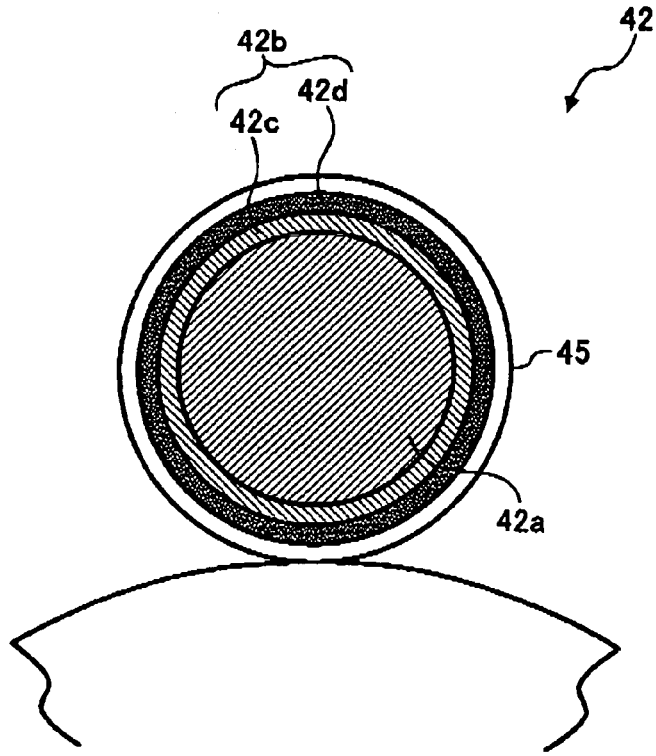
FIG. 12 is a schematic diagram showing a charging member included in the charging module.

FIGS. 9A and 9B are perspective and side views of the charging module 4. FIG. 10 is a perspective view of the charging module 4. FIG. 11 is a perspective view showing the charging module loaded in the process cartridge 1. FIG. 12 illustrates a structure including a charging roller.

As shown in FIGS. 9A, 9B, and 10, the charging module 4 includes a housing 41, a charging member 42, charging cleaning rollers 44, spacer members 45, and supporting members 46.

The housing 41 accommodates the charging roller 42, spring members 43, charging cleaning rollers 44, spacer members 45, and supporting members 46.

The charging roller 42 is disposed to confront the photoconductive element 3. The charging roller 42 is rotatably supported by the supporting members 46 and is pressed by the spring members 43 in a direction towards the surface of the photoconductive element 3.

The charging cleaning rollers 44 prevent the charging roller 42 from vibrating, and remove dirt on the charging roller 42 and the spring members 43.

The charging cleaning rollers 44 are rotatably supported by bearings 47 formed on the housing 41. The charging cleaning rollers 44 are held in contact with the charging roller 42 to perform a cleaning operation of the charging roller 42 along the outer circumference of the charging roller 42. This may prevent the charging roller 42 from an abnormal discharging generated when foreign material such as toner, paper dust, or breakage of parts adheres to the surface of the charging roller 42.

The charging cleaning rollers 44 may be preferably formed by a brush-shaped resin material. In addition, it is possible to provide a plurality of the charging cleaning rollers 44.

The supporting members 46 are pushed by the respective spring members 43 in a direction to separate from the housing 41, in a direction towards the rotary axis of the photoconductive element 3, and the movement of the supporting member 46 is restricted by the restricting part (root shown) which is formed on the housing 41. By using the above-described structure, the charging roller 42 maintains a predetermined distance from the photoconductive element 3 by the provision of the spacer member 45, and the charging roller 42 is also prevented from vibrating, when the charging module 4 is loaded into the process cartridge 1. Moreover, when removing the charging module 4, it is possible to handle the charging module 4 by itself.

As shown in the FIG. 11, the charging module 4 is inserted between fitting parts 15*f* and 15*r* provided on the side plates 11*f* and 11*r* of the process cartridge 1 of FIGS. 6 and 7. The charging module 4 is positioned by being fitted between the fitting parts 15*f* and 15*r*, and is fixed on the second frame body 2*b*. The reference character "f" included with the reference numerals "11" and "15" indicates the front side of the process cartridge 1, and the reference character "r" included with the reference numerals "11" and "15" indicates the rear side of the process cartridge 1.

The charging roller 42 of the charging module 4 may have any suitable structure, but the roller shape described below is preferable. The charging roller 42 shown in FIG. 12 includes a shaft part 42*a* made of a core material provided at the center, and a main body part 42*b*. The main body part 42*b* includes an intermediate resistor layer 42*c* provided around the shaft part 42*a*, and a surface layer 42*d* provided around the intermediate resistor layer 42*c* and forming the outermost layer. For example, the shaft part 42*a* is formed from a metal, such as stainless steel and aluminum, having a high rigidity and high conductivity, with a diameter from approximately 8 mm to approximately 20 mm. Alternatively, the shaft part 42*a* is formed from a conductive resin or the like having a high rigidity and a volume resistivity of $1\times10^{3}$ Ω·cm or less, and preferably of $1\times10^{2}$ Ω·cm or less. Preferably, the intermediate resistor layer 42*c* has a thickness from approximately 1 mm to approximately 2 mm and a volume resistivity from $1\times10^{5}$ Ω·cm to $1\times10^{9}$ Ω·cm. Preferably, the surface layer 42*d* has a thickness of approximately 1 μm and a volume resistivity from $1\times10^{6}$ Ω·cm to $1\times10^{12}$ Ω·cm. It is preferable that the volume resistivity of the surface layer 42*d* is higher than the electrical resistivity of the intermediate resistor layer 42*c*. Although the main body part 42*b* of this embodiment has a two-layer structure made up of the intermediate resistor layer 42*c* and the surface layer 42*d*, the main body part 42*b* is not limited to such a structure, and the main body part 42*b* may be formed by a single-layer structure or a multi-layer structure such as a three-layer structure, The gap between the charging roller 42 and the photoconductive element 3 is 100 μm or less or, preferably from approximately 20 μm to approximately 50 μm, by the spacer member 45. By maintaining this gap, it is possible to prevent the formation of an abnormal image when the charging module 4 operates. The gap may be adjusted by the fitting part 15 which fits the process cartridge 1 and the charging module 4.

Referring to FIGS. 13A to 15, a structure of the developing module 5 is described.

Figure 13A:
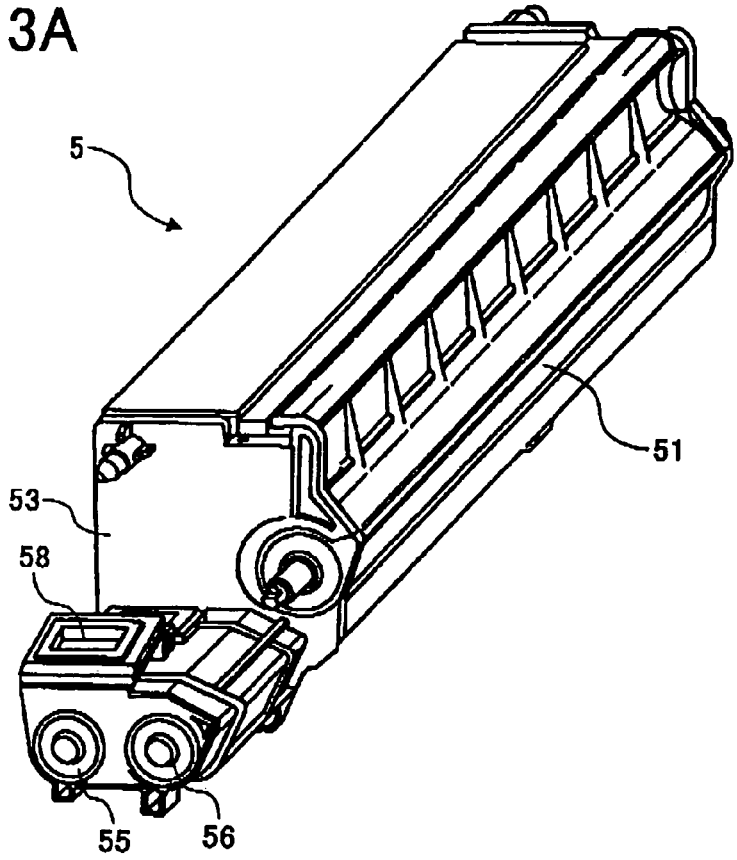
FIGS. 13A and 13B are perspective views of a developing module included in the process cartridge.
Figure 13B:
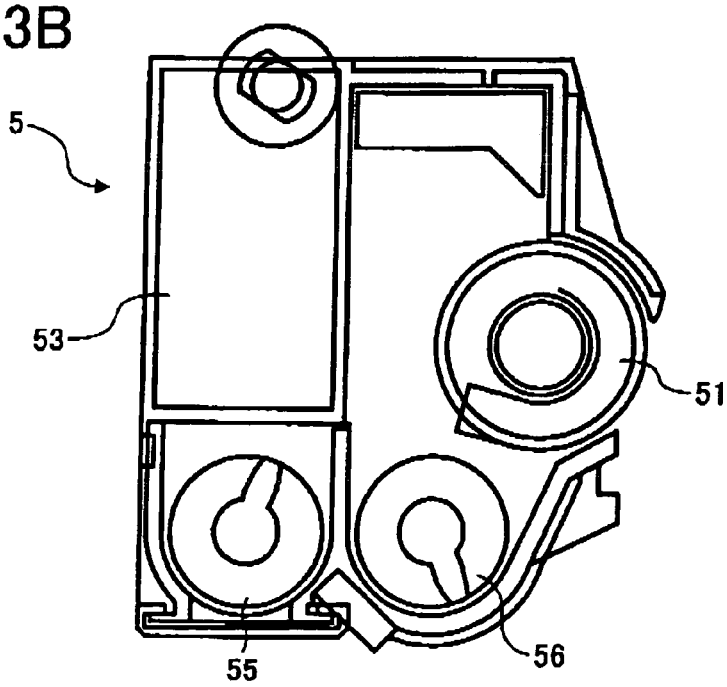

FIGS. 13A and 13B are perspective and side views of the developing module. The developing module 5 is loaded into the first frame body 2*a* as shown in FIG. 2. The developing module 5 includes a developing sleeve 51, a supply opening 58, a mixing screw 55, a supplying roller 56, and a container 53.

The developing sleeve 51 is disposed close to the photoconductive element 3, and forms a developer bearing member.

The supply opening 58 is an opening through which the toner is supplied from a toner container (not shown) which is provided separately from the developing module 5.

The mixing screw 55 is used to mix and agitate the supplied toner.

The supply roller 56 supplies the toner mixed in the developing module 5 to the photoconductive element 3.

The container 53 accommodates new toner.

Figure 14:
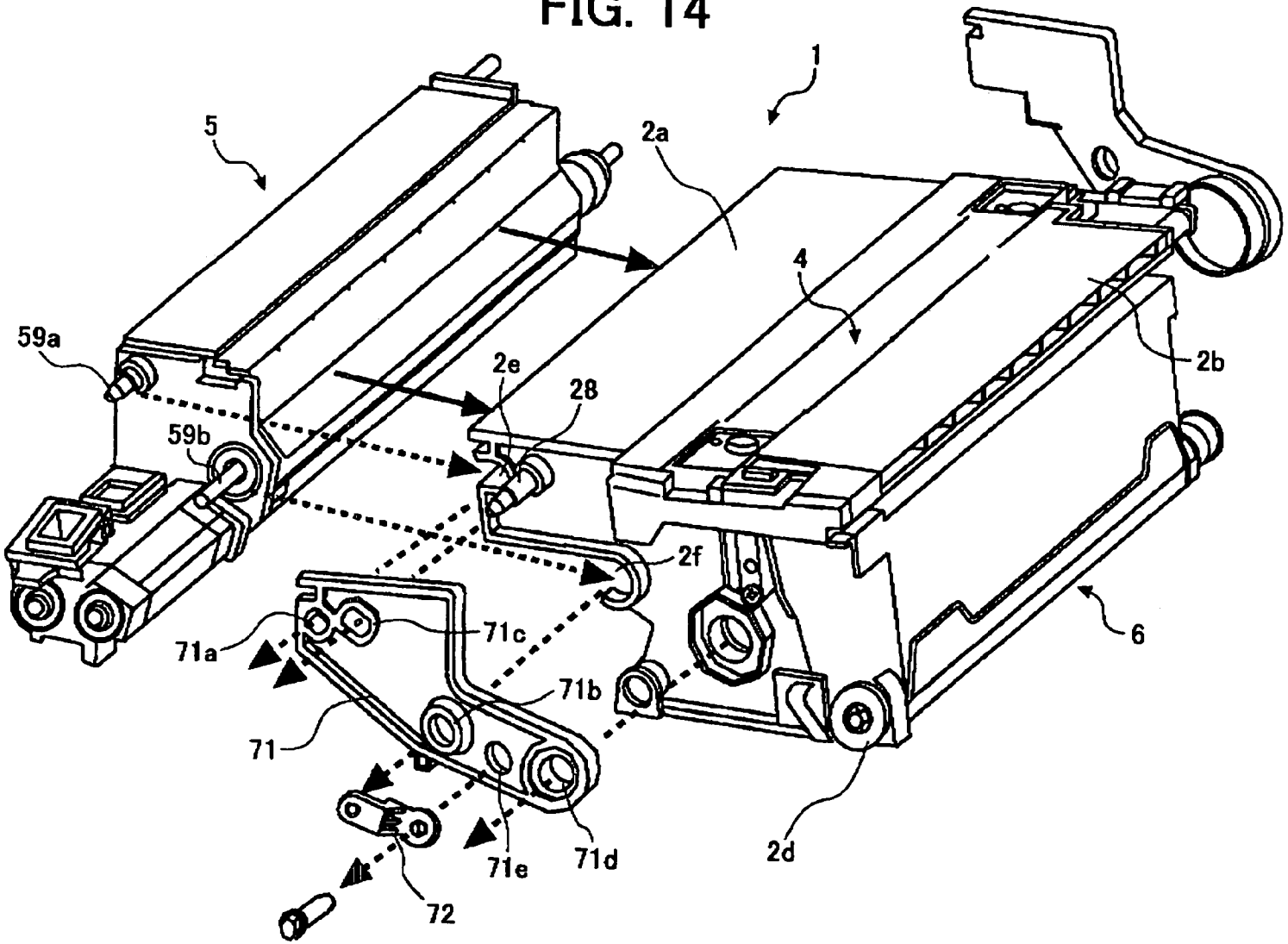
FIG. 14 is a perspective view of the developing module before being loaded onto the process cartridge.
Figure 15:
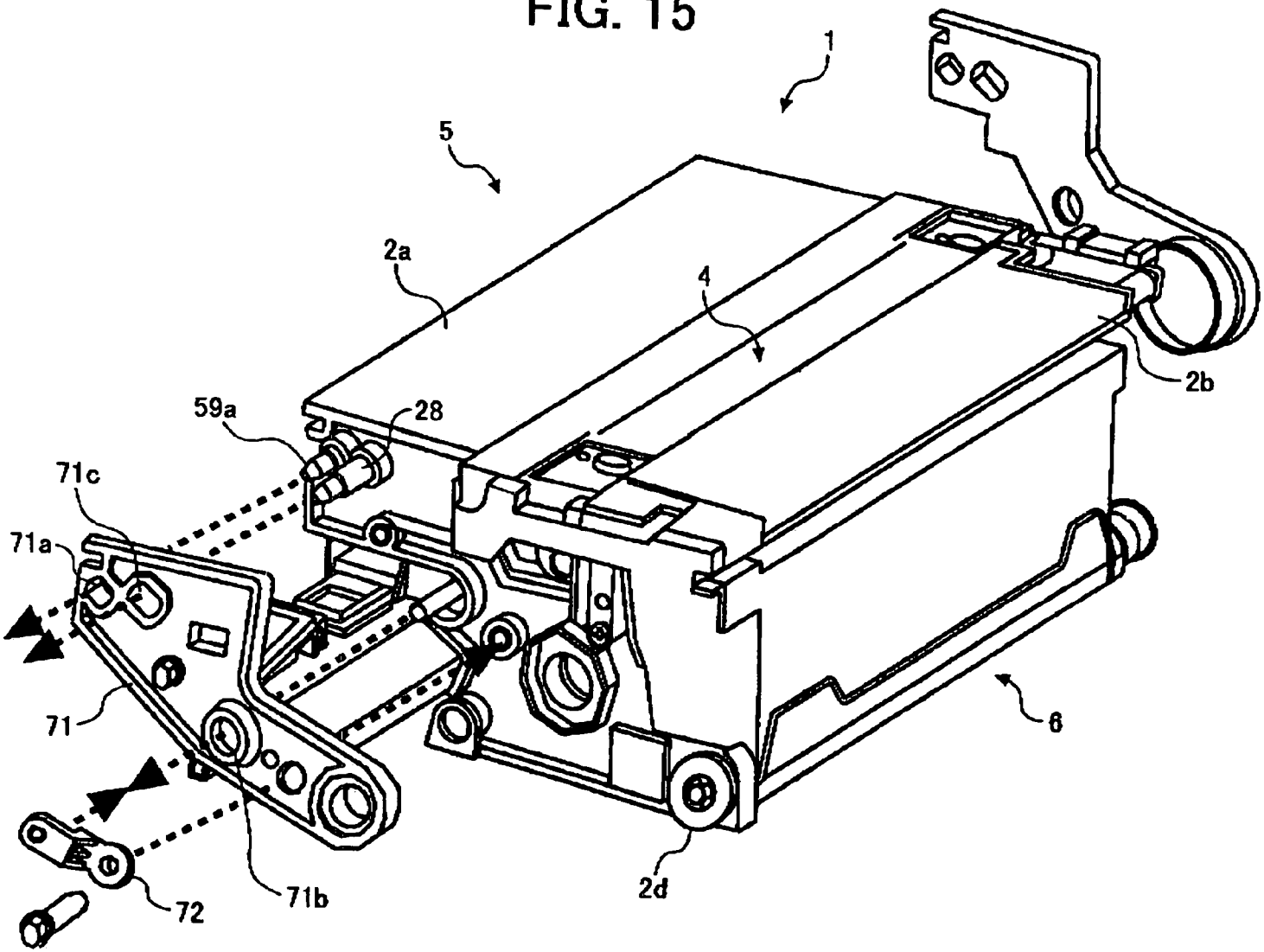
FIG. 15 is a perspective view of the developing module after being loaded onto the process cartridge.

FIGS. 14 and 15 show a process of mounting the developing module 5 to the process cartridge 1.

The developing module 5 can be engaged with the first frame body 2*a* of the process cartridge 1 by positioning members 71 and angular positioning members 72 which respectively form developing position determining members. To mount the developing module 5 into the first frame body 2*a* of the process cartridge 1, first projecting guides 59*a* of the developing module 5 are fitted into guide grooves 2*e* formed on the first frame body 2*a*, and inserted into holes 71*a* of the positioning members 71. A second projecting guide 59*b* which is a rotatable shaft is inserted into holes 71*b* of the positioning member 71. The second projecting guide 59*b* has a D-shaped cross section and is formed coaxially with the developing sleeve 51. A shaft of the photoconductive element 3 is inserted into holes 71*d* of the positioning member 71.

As described above, a main reference for engaging the developing module 5 with the process cartridge 1 may be determined, which results in the positioning of the photoconductive element 3 relative to the developing sleeve 51.

At the same time, the first projecting guides 59*a* of the developing module 5 are inserted into guide parts 2*f* of the first frame body 2*a*. Projecting guides 28 formed on the first frame body 2*a* are inserted into holes 71*c* of the positioning members 71.

As described above, a sub reference for the engaging of the developing module 5 with the process cartridge 1 may be determined.

the main and sub references, the third frame body 2*c* including the developing module 5 may completely be mounted to the first frame body 2*a* of the process cartridge frame body 2.

After the engagement using the positioning member 71 is finished, the second projecting guide 59*b* of the developing module 5 is inserted into holes 71*e* which have a D-shaped cross section, and inserted to the angular positioning member 72. The main pole direction with respect to the photoconductive element 3 can be adjusted by the angular positioning member 72. Thus, the angular positioning member 72 is fixed to the process cartridge frame body 2.

The cross sections of the second projecting guide 59*b* and the holes 71*e* of the positioning member 71 are not limited to the D-shape, as long as it is possible to prevent the second projecting guide 59*b* from rotating and to position the second projecting guide 59*b* to the predetermined angular position.

The developing module 5 can easily be separated from the process cartridge frame body 2 by removing the angular positioning members 72 and the positioning members 71 in a reverse order to that described above.

In this embodiment, the developing module 5 uses the dry type two-component developer. However, the developing module 5 is not limited to the dry type two-component developer, and recycled toner maybe used for the dry type developer. In addition, the developing module 5 may use a single-component magnetic developer or a single-component nonmagnetic developer.

The developing module 5 may be provided with the supply opening 58 for supplying the toner, as in the case of this embodiment. The process cartridge 1 is shipped with the supply opening 58 sealed by a seal, a lid or the like, and the supply opening 58 is first opened when using the process cartridge 1. After the supply opening 58 is opened and the toner within the process cartridge 1 is used, the toner may be supplied to the process cartridge 1 via the supply opening 58 when the amount of toner within the process cartridge 1 becomes low, to enable the process cartridge 1 to be used again. The process cartridge 1 may accommodate the newly supplied toner within the container 53. The toner that is supplied may be newly supplied or, may be recovered toner for reuse. An accommodating part (not shown) for accommodating the toner that is to be supplied may be provided in the main body of the image forming apparatus 100. In addition, such an accommodating part may be provided within the process cartridge 1. In such cases, the developing module 5 can be used repeatedly without having to replace the developing module 5, by supplying the toner to the developing module 5 when desired.

Referring to FIGS. 16 to 19, a structure of the cleaning module 6 is described.

Figure 16:
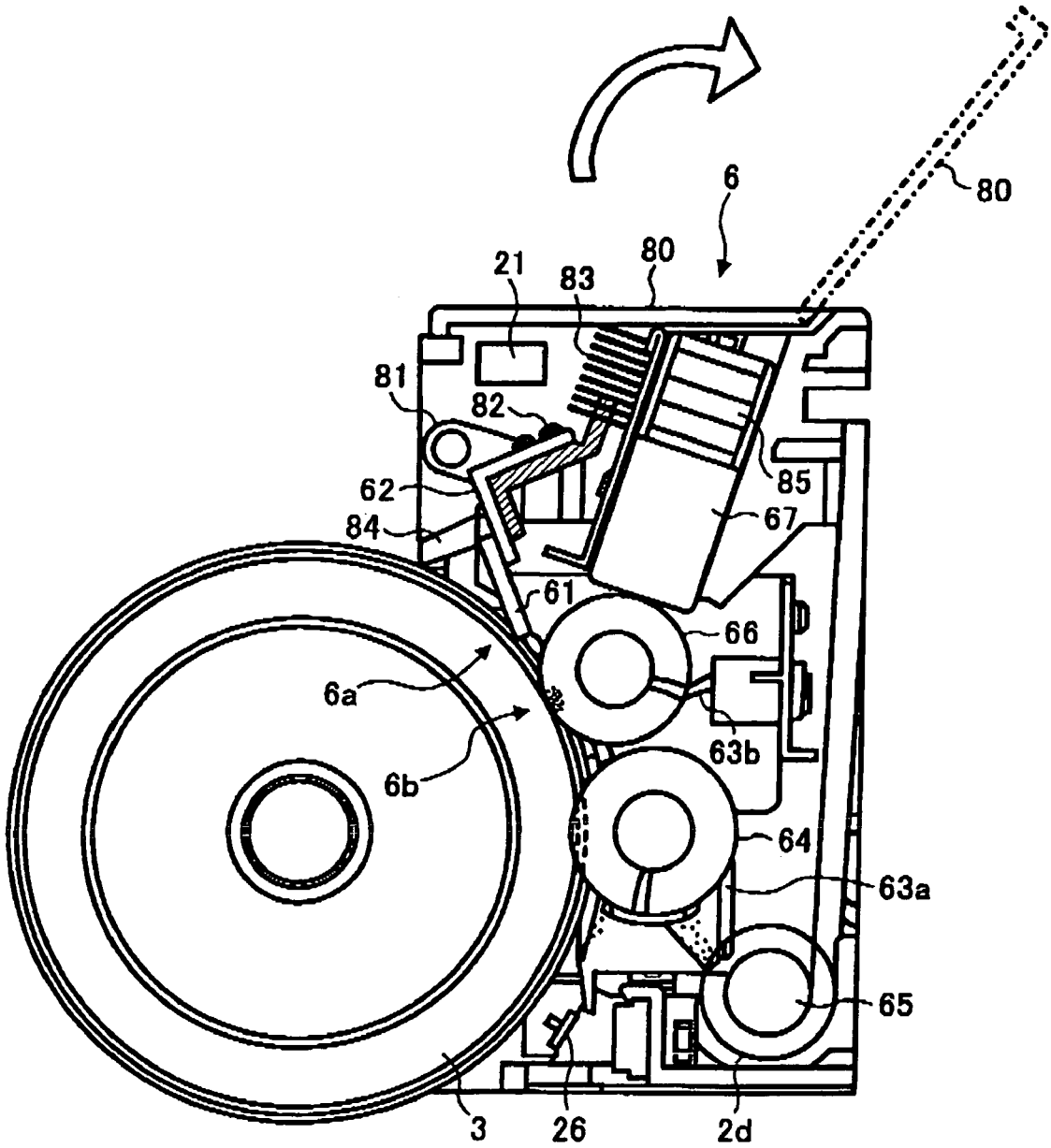
FIG. 16 is a cross sectional view of a cleaning module included in the process cartridge.

In FIG. 16, as previously described, the cleaning module 6 cleans the photoconductive element 3, and includes the cleaning unit 6*a* and the coating unit 6*b*.

The cleaning unit 6*a* includes a cleaning blade 61, a supporting member 62, a pressing bracket 81, screws 82, a pressing spring 83, and a regulating member 84.

The cleaning blade 61 removes the residual toner on the surface of the photoconductive element 3.

The supporting member 62 presses the cleaning blade 61 against the photoconductive element 3.

The pressing bracket 81 is detachably attached by the supporting member 62 by the screws 82, and presses the photoconductive element 3 with a leading portion of the cleaning blade 61 via the supporting member 62.

The pressing spring 83 is a pressing member for pressing the pressing bracket 81 so that the pressing bracket 81 can turn in a predetermined direction.

The regulating member 84 regulates the turns of the pressing bracket 81 against a pressing force of the pressing spring 83 solely when the photoconductive element 3 is removed from the process cartridge 1.

The cleaning unit 6*a* further includes a bias roller 64, a recovery roller 66, flickers 63*a* and 63*b*, and a conveying auger 65.

The bias roller 64 controls the amount of charge of the residual toner.

The recovery roller 66 recovers the toner adhered on the cleaning blade 61.

The flicker 63*a* removes the residual toner adhered on the bias roller 64.

The flicker 63*b* removes the residual toner adhered on the recovery roller 66.

The conveying auger 65 is formed coaxially to the rotary axis or the engaging part 2*d* of the process cartridge frame body 2.

The residual toner cleaned by the cleaning blade 61 and the residual toner removed by the flickers 63*a* and 63*b* fall downwards due to its own weight, and is conveyed outside the process cartridge 1 by the conveying auger 65 to be recovered within a waste toner accommodating part (not shown).

The coating unit 6*b* includes a lubricant body 67, and a coating roller 66. The coating roller 66 contacts the lubricant body 67 and wipes the lubricant from the lubricant body 67 to supply the lubricant on the surface of the photoconductive element 3. In this embodiment, the coating roller 66 also functions as the recovery roller 66, and thus, the roller 66 will hereinafter be referred to as a recovery and coating roller 66. A pressuring spring 85 may be provided to push the lubricant body 67 against the recovery and coating roller 66 with a predetermined pushing force or pressure. In this case, the lubricant body 67 may have a rectangular parallelepiped shape and be held in the cleaning module 6 with the lubricant body 67 contacting the recovery and coating roller 66 with the predetermined pressure applied from the pressuring spring 85. Thus, the recovery and coating roller 66 simultaneously recovers the residual toner adhered on the cleaning blade 61 and coats the lubricant on the surface of the photoconductive element 3.

Although FIG. 16 shows the coating unit 6*b* included in the cleaning module 6, the coating unit 6*b* may be formed as a replaceable module that is separated from the cleaning unit 6*a*. In this case, the module of the coating unit 6*b* can be replaced independently of the cleaning unit 6*a*.

The recovery and coating roller 66 has a shape extending along the axial direction of the photoconductive element 3. The pressuring spring 85 constantly pushes the lubricant body 67 against the recovery and coating roller 66 to substantially use up the lubricant body 67 for the lubricant coating. Because the lubricant body 67 is consumed, the thickness of the lubricant body 67 decreases with time or use. However, the lubricant can be wiped to be supplied and coated on the photoconductive element 3 in a stable manner, by constantly pushing the lubricant body 67 against the recovery and coating roller 66 by the action of the pressuring spring 85.

Specific examples of the lubricant are metal salts of fatty acids such as lead oleate, zinc oleate, copper oleate, zinc stearate, cobalt stearate, iron stearate, copper stearate, zinc palmitate, copper palmitate, and zinc linoleate: fluorine resin particles such as polytetrafluoroethylene, polychlorotrifluoroethylene, polyvinylidenefluoride, polytrifluorochloroethylene, polydichloro difluoroethylene, tetrafluoroethylene-ethylene copolymers, and tetrafluoroethylene-hexafluoropropylene copolymers. The metal salts of fatty acids are preferable to substantially reduce the friction coefficient of the photoconductive element 1. Among these materials, zinc stearate and calcium or calcium stearate are more preferable.

In FIG. 16, the lid 80 that is rotatably opened and closed is arranged at the top of the second frame body 2*b* for removing the cleaning unit 6.

When the lid 80 is in an open position, the pressing spring 84, the screws 82, the pressing bracket 81, the supporting member 62, the cleaning blade 61, the pressuring spring 85, the lubricant body 67 and the like can be seen from the top of the cleaning module 6. Respective upper portions of the pressing spring 84 and the pressuring spring 85 are engaged with engaging members (not shown). When the screws 82 are unscrewed in the open position, the cleaning blade 61 attached with the supporting member 62 can be removed and replaced with a new cleaning blade. When the pressuring spring 85 attached with the engaging member is removed, the lubricant body 67 can be removed and replaced with a new lubricant body. The lubricant body 67 may be arranged without the pressuring spring 85 so that the lubricant body 67 can press contact with the recovery and coating roller 66 by the own weight of the lubricant body 67. When the lubricant body 67 is arranged without the pressuring spring 85, the trailing edge of the lubricant body 67 is exposed in the open position of the lid 80. Thereby, the lubricant body 67 can be removed and replaced with the trailing edge of the lubricant body 67 being picked up.

Figure 17:
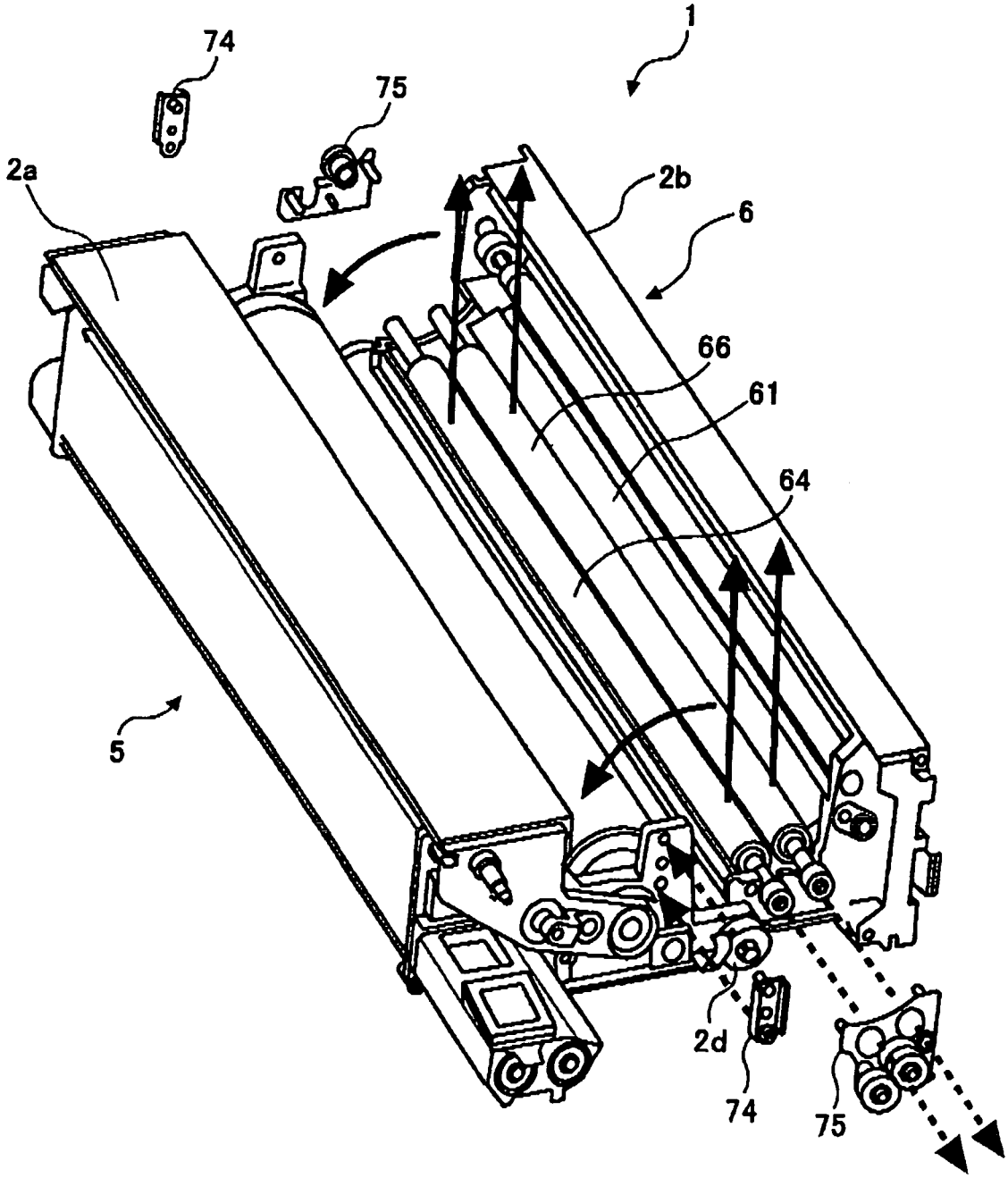
FIG. 17 is a perspective view of the cleaning module loaded onto a second frame body of the process cartridge.

In FIG. 17, the process cartridge 1 is placed on a horizontal plane such as a desk, and the second frame body 2*b* of the process cartridge 1 is in the open position, rotating the second frame body 2*b* by substantially 90 degrees. In the open position of the second frame body 2*b* as shown in FIG. 17, the cleaning module 6 and the photoconductive element 3 can be seen from the top of the process cartridge 1. To open the second frame body 2*b* as shown in FIG. 17, screws (not shown) are removed from the respective positioning members 74 attached to the front and rear sides of the process cartridge frame body 2, and the second frame body 2*b* is rotated around the engaging part 2*d*.

Rotating members which can easily wear out, such as the bias roller 64 and the recovery and coating roller 66, are exposed facing upwards. In FIG. 17, the front and rear side plates of the process cartridge frame body 2 are arranged to have notches to receive both axial ends of these rotating members so that the rotating members can be removed upwards. Prior to the removal of the rotating members, the cleaning position determining members 75 attached to the front and rear side plates of the process cartridge frame body 2 are removed. The cleaning position determining members 75 are used to position and fix the axis of the rotating members with respect to both side plates of the second frame body 2*b*. After the rotating members are removed, the cleaning blade 61 with the supporting members 62 and/or the lubricant body 67 can be removed upward via the open space of the second frame body 2*b*. Depending on the layout of the cleaning module 6, the cleaning blade 61 with the supporting members 62 and/or the lubricant body 67 can, be removed before the rotating members are removed.

Figure 18:
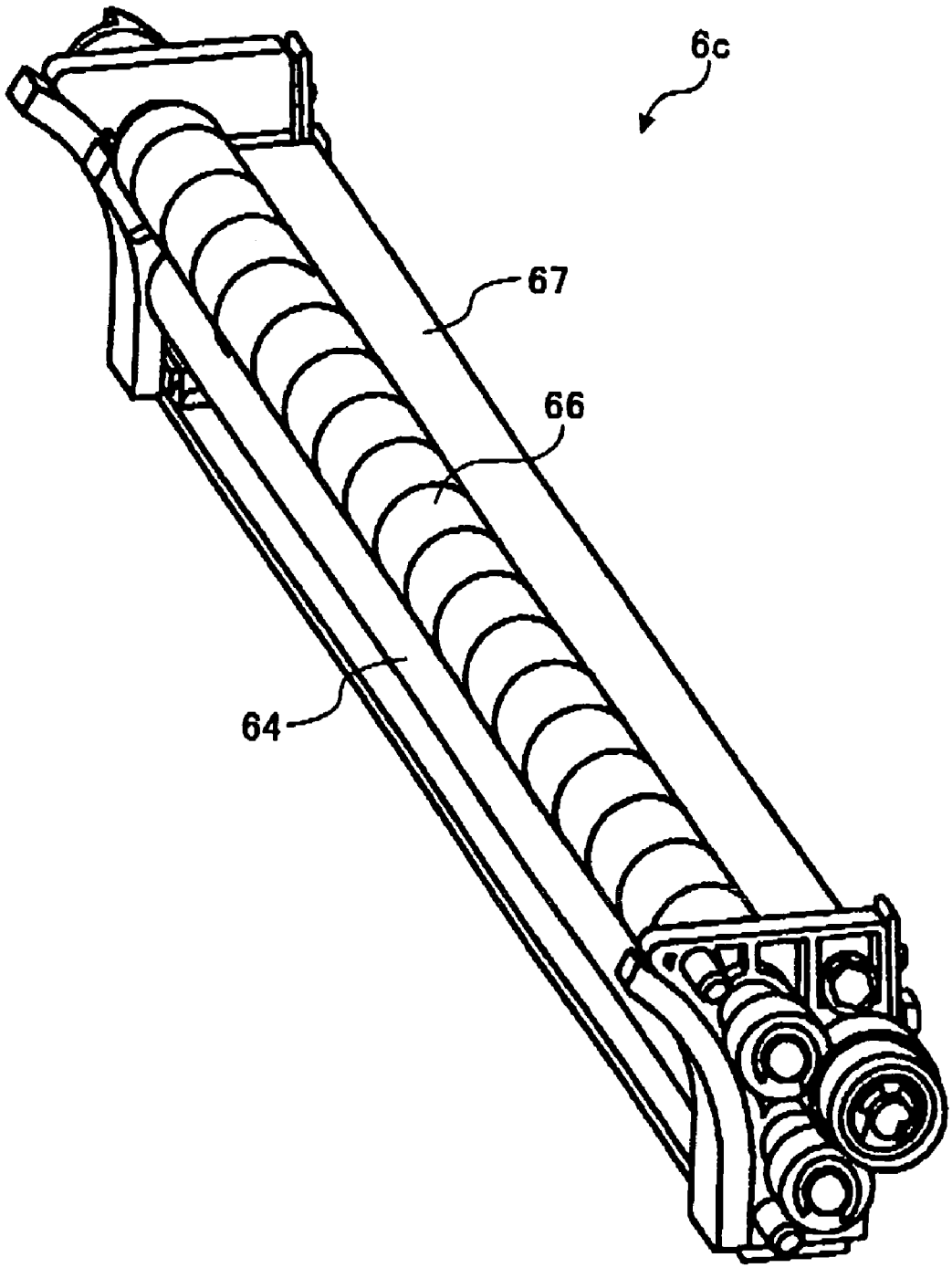
FIG. 18 is a perspective view of the cleaning module shown inside the module.
Figure 19:
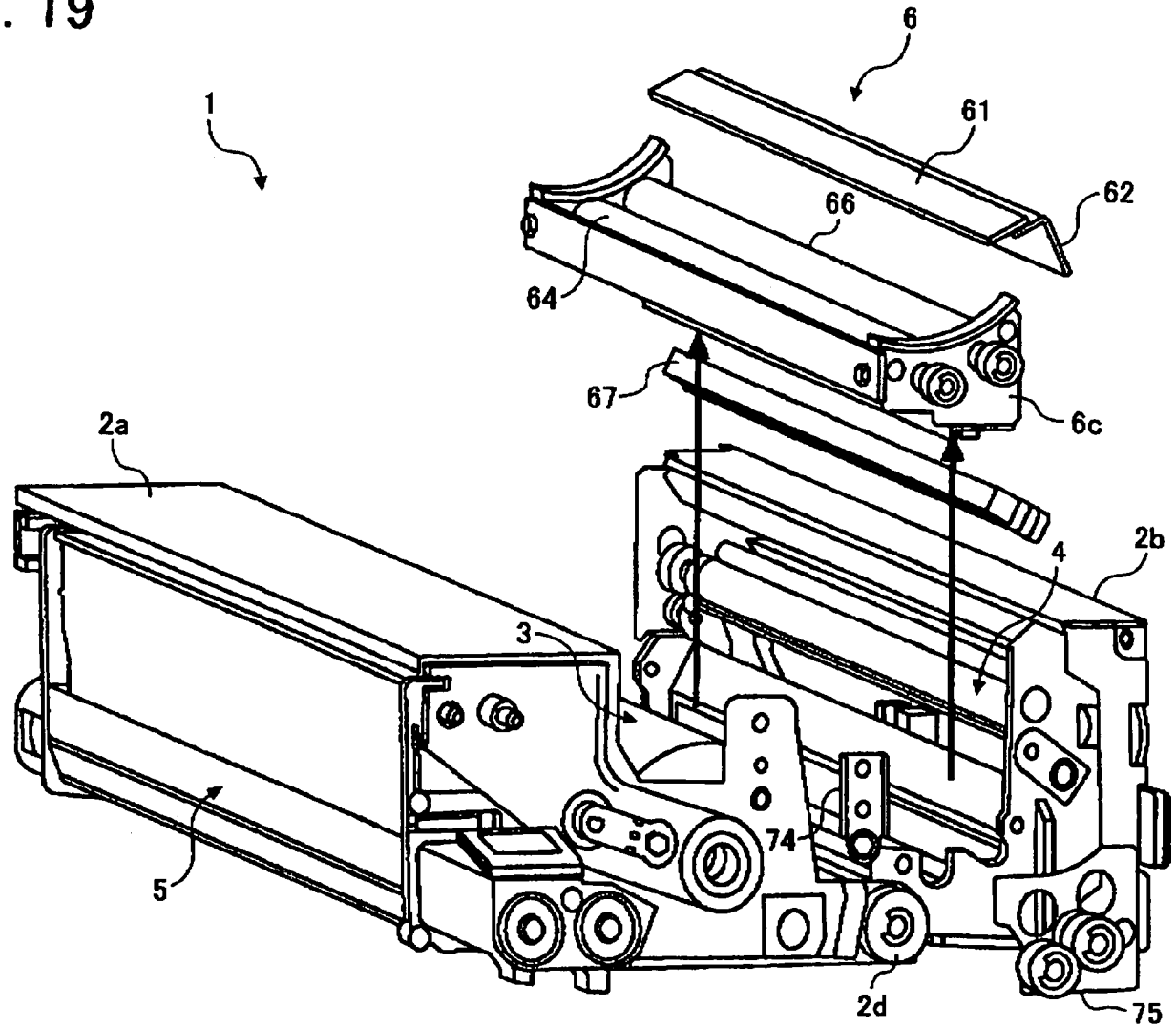
FIG. 19 is a perspective view generally showing the second frame body, turned to form an open space and parts of the cleaning module removed from the open space.

In FIGS. 18 and 19, a structure and function of a cleaning sub-module 6*c* of the cleaning module 6 in the process cartridge 1 are illustrated, as an alternative example of the present invention.

The cleaning sub-module 6*c* includes members such as the bias roller 64, the recovery and coating roller 66, the lubricant body 67 so that the above-described members can be replaced simultaneously in units of the members of the cleaning module 6. In this embodiment, parts having relatively short replacement intervals such as first and second flickers for removing the residual toner adhered on the bias roller 64 and the recovery and coating roller 66 may also be included in the cleaning sub-module 6*c*. In addition, the bias roller 64 for controlling the amount of charge of the residual toner, the recovery and coating roller 66 for coating and recovering the lubricant, and the lubricant body 67 may be included in the cleaning sub-module 6*c*. With the above-described structure, the cleaning sub-module 6*c* can be replaced separately from the cleaning module 6. Both ends of the rotating members such as the bias roller 64 and the recovery and coating roller 66 are rotatably supported at both end plates of the cleaning sub-module 6*c*.

FIG. 19 shows the second frame body 2*b* turned to form an open space and the cleaning sub-module 6*c* removed via the open space. With the structure shown in FIG. 19, the cleaning sub-module 6*c* can easily be removed from the second frame body 2*b*. The cleaning sub-module 6*c* is fixed on the second frame body 2*b* by the cleaning position determining members 75 each having two pins. The cleaning sub-module 6*c* can be replaced when the second frame body 2*b* is turned approximately 90 degrees with respect to the first frame body 2*a* and opened. Turning the second frame body 2*b* as described above allows the cleaning sub-module 6*c* to face upward. When the cleaning position determining members 75 are removed, the cleaning sub-module 6*c* can easily be removed.

It is desirable that the pins of the cleaning position determining members 75 are positioned with respect to the core of a pivot shaft of the pressing bracket 81. Conversely, (a) the pins of the cleaning position determining members 75 may be positioned with the pins coaxial with the core of the pivot shaft or (b) the protruding parts of the pivot shaft are fitted to the holes of the cleaning position determining members 75. With the above-described operations, in setting accuracy, for example, a contact angle with respect to the photoconductive element 3 may be increased.

In the process cartridge 1 of the present invention, each of the photoconductive element 3, the charging module 4, the developing module 5, and the cleaning module 6 can be removed and replaced. In particular, each of the charging module 4, the developing module 5, the cleaning module 6, and the cleaning sub-module 6*c* can independently be removed and replaced.

The charging module 4 can be removed by pulling-the-charging module 4 upwards from the fitting part 15 of the process cartridge 1.

The developing module 5 can be removed from the process cartridge frame body 2 by removing the angular positioning member 72 and further the positioning member 71, as shown in FIG. 14.

The angular positioning member 72 cannot be used. Namely, the developing module 5 can be removed and replaced by using the positioning member 71 solely.

When the frame body positioning member 74 is removed and the second frame body 2*b* is turned and opened with respect to the first frame body 2*a*, the parts included in the second frame body 2*b* can be removed by removing the cleaning position determining members 75. Further, with the first, second, and third frame bodies 2*a*, 2*b*, and 2*c* being relatively positioned, the cleaning module 6 allows the cleaning blade 61 and the lubricant body 67 to be removed by opening the lid 80 provided on the top of the second frame body 2*b*.

Figure 20:
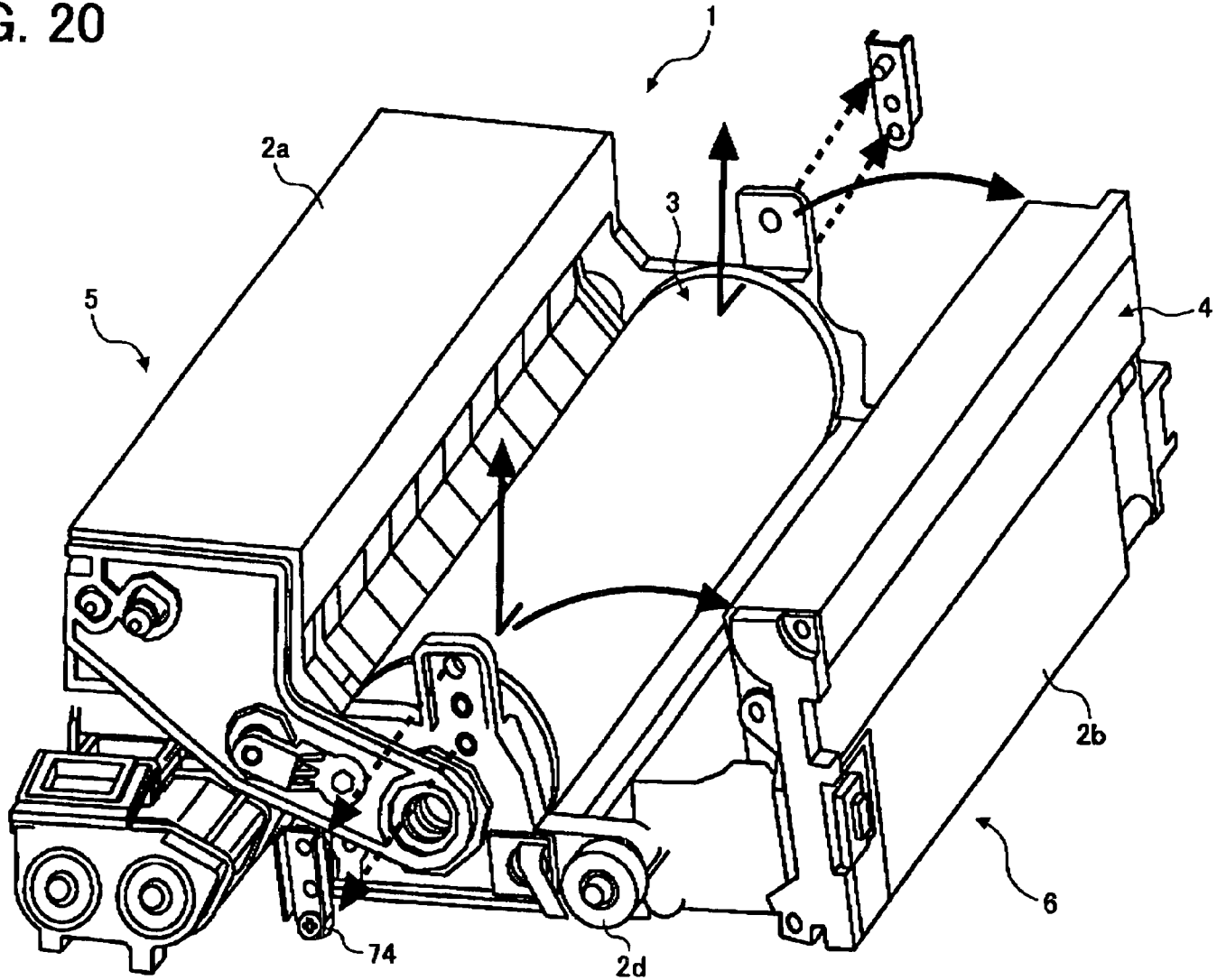
FIG. 20 is a perspective view showing the photoconductive element to be removed and separated from the process cartridge.
Figure 21:
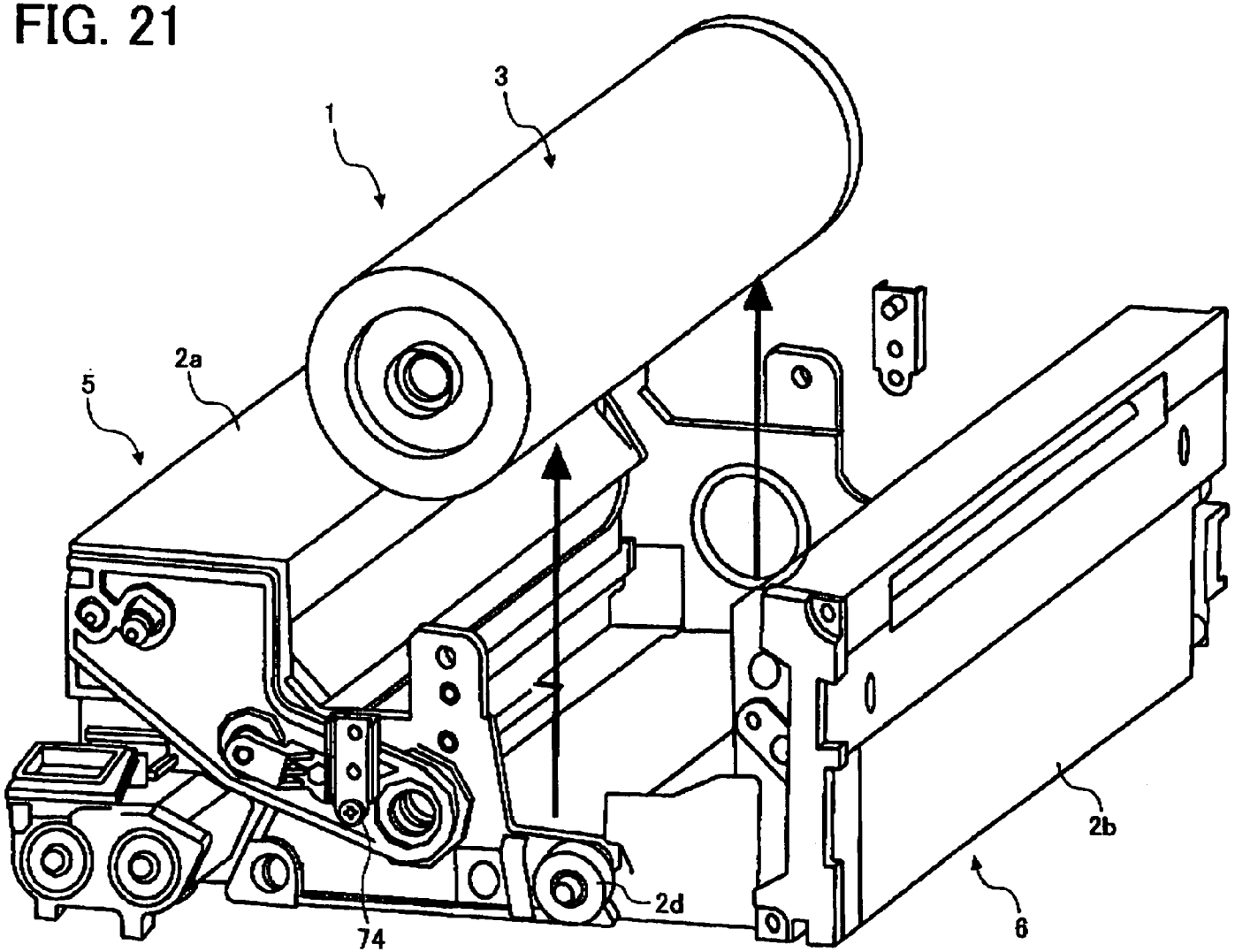
FIG. 21 is a perspective view showing the photoconductive element after being removed and separated from the process cartridge.

Referring to FIGS. 20 and 21, a process of removing the photoconductive element 3 from the process cartridge 1 is described.

As shown in FIGS. 20 and 21, the cleaning module 6 can be removed by removing the frame body positioning member 74 and turning the second frame body 2*b* by approximately 90 degrees with respect to the first frame body 2*a* to an open space. When the cleaning blade 61 contacts the photoconductive element 3 to remove the residual toner from the surface of the photoconductive element 3, the tip of the cleaning blade 61 eventually wears out and needs to be replaced. Further, when the lubricant body 67 contacts the photoconductive element 3 to coat the surface of the photoconductive element 3, the lubricant body 67 is consumed and needs to be replaced. When the second frame body 2*b* is turned relative to the first frame body 2*a* to form the open space, the cleaning blade 61 and the recovery and coating roller 66 can be removed independently. Further, the recovery and coating roller 66 and the lubricant body 67, both of which are easy to wear and be consumed in the cleaning sub-module 6*c*, can simultaneously and integrally be removed via the open space.

The positioning member 74 fixing the second frame body 2*b* is removed, and the second frame body 2*b* is turned about the engaging part 2*c* to form an open space above the process cartridge 1, as shown in FIG. 20. In this state, the photoconductive element 3 is merely supported by the support part 13 of the process cartridge frame body 2 and is not fixed to the process cartridge 1. The photoconductive element 3 can easily be removed by pulling the photoconductive element 3 upwards as shown in FIG. 21 while pushing the photoconductive element 3 against the frame body positioning member 75.

In this embodiment, the process cartridge 1 can be supplied with new toner. As previously described, the process cartridge 1 is initially sold with the supply opening 58 covered by a seal, a lid or the like, which is removed at a first use of the process cartridge 1. In general, the used process cartridge 1 is disposed of without refilling. However, the process cartridge 1 in this embodiment can be reused if new toner is supplied. Also, the process cartridge 1 can stock new toner in the container 53. It is applicable that such toner is supplied into the process cartridge 1 after toner in the process cartridge 1 is used up, or the toner is reused after being recycled. Also, it is applicable that the image forming apparatus 100 includes a toner accommodating portion (not shown) to supply new toner to the process cartridge 1. In such case, because a developing module 5 can be supplied with new toner, the developing module 5 may be used repeatedly.

Preferably, the toner particle used in the image forming apparatus 100 has an average circularity of from approximately 0.93 to approximately 1.00. A circularity of a dry toner manufactured by a dry grinding method is thermally or mechanically controlled to be within the above-described range. For example, a thermal method in which dry toner particles are sprayed with an atomizer together with hot air can be used to prepare a toner having a spherical form. That method is a thermal process of ensphering the toner particle. Alternatively, a mechanical method in which a spherical toner can be prepared by agitating, dry toner particles in a mixer such as a ball mill, with a medium such as a glass having a low specific gravity can be used. However, aggregated toner particles having a large particle diameter are formed by the thermal method or fine powders are produced by the mechanical method. Therefore, it is necessary to subject the residual toner particles to a classifying treatment. If a toner is produced in an aqueous medium, the shape of the toner can be controlled by controlling the degree of agitation in the solvent removing step.

The circularity is defined by following Equation 1:

$$\text{Circularity } SR = (\text{Circumference } A / \text{Circumference } B),$$

where "Circularity SR" represents a circularity of a particle, "Circumference A" represents a circumference of circle identical in area with the projected grain, image of the particle, and "Circumference B" represents a circumference of the projected grain image.

As the shape of a toner particle is close to a truly spherical shape, the value of circularity SR becomes close to 1.00. The toner particles having a high circularity SR are easily influenced by a line of electric force when the toner is present on a carrier or a developing sleeve used for an electrostatic developing method, and an electrostatic latent image formed on the surface of the photoconductive element 1 is faithfully developed by the toner along the line of electric force thereof.

When small dots in an electrostatic latent image are developed, such spherical toner particles are adhered to the latent dot images while being uniformly and densely dispersed. Therefore, a toner image having good thin line reproducibility can be produced without causing toner scattering. In addition, because the toner particles having the high circularity SR have a smooth surface and suitable fluidity (or flowability), these toner particles are easily affected by the line of electric force and accurately move along the line of electric force, and a transfer efficiency (or transferring rate) becomes high to enable a high-quality image to be formed. Even when the intermediate transfer belt 106*a* pushes against the photoconductive element 3, the toner particles having the high circularity SR uniformly contact the intermediate transfer belt 106*a*, and a uniform contact area contributes to the improvement of the transfer efficiency. However, when the average circularity of the toner particles is less than 0.93, accurate development and transfer with a high transfer efficiency may not be achieved. This is because the charge on the toner surface is nonuniform when the toner particles have undefined shapes, and it is difficult for the toner particles to move accurately with respect to the electric field due to the center of gravity and the center of the charging differing from one another.

After the image forming operations which are previously described referring to FIG. 1 are performed by the process cartridge 1 of the image forming apparatus 100, the cleaning module 6 performs the cleaning operations as follows.

After the image is formed on the surface of the photoconductive element 3, the recovery and coating roller 66 of the coating unit 6*b* wipes the zinc stearate lubricant from the lubricant body 67, and coats this lubricant on the surface of the photoconductive element 3 by making sliding contact with the photoconductive element 3. Then, the cleaning blade 61, in contact with the photoconductive element 3, presses the lubricant to form a thin lubricant layer on the surface of the photoconductive element 3. By forming the thin lubricant layer, the residual toner on the photoconductive element 3 becomes more easily cleanable (or removable), and the residual toner can be removed even when the toner particles have a high circularity.

The thin lubricant layer formed on the surface of the photoconductive element 3 by the cleaning blade 61 of the cleaning module 6 reduces a friction coefficient, in a unit of "μ", of the surface of the photoconductive element 3 preferably to 0.4 or less. The friction coefficient of the surface of the photoconductive element 3 may control the setting conditions of the coating unit 6*b*, such as a pressure applied to the lubricant body 67 by the pressing spring, the brush density, the brush diameter, the rotational speed, or the rotating direction of the recovery and coating roller 66.

By setting the friction coefficient of the surface of the photoconductive element 3 to 0.4 or less, it is possible to suppress the friction between the cleaning blade 61 and the photoconductive element 3 from becoming large, suppress deformation or turning of the cleaning blade 61, prevent the toner from slipping past the cleaning blade 61, and suppress the generation of poor cleaning. Furthermore, the above-described friction coefficient is more preferably 0.3 or less. The friction coefficient of the surface of the photoconductive element 3 is affected by other parts, modules or units provided within the image forming apparatus 100, and the value of the friction coefficient changes from the value immediately after the image formation. However, for the image formation with respect to approximately 1,000 recording media, namely, A4-size recording sheet, the value of the friction coefficient remain substantially constant. Accordingly, the friction coefficient in this embodiment refers to the friction coefficient that becomes substantially constant in the steady state.

Because the thin line reproducibility is improved when a volume-based average particle diameter Dv of the toner used in this embodiment is 8 gm or less; conversely, the developing characteristic and the cleaning characteristic deteriorate when the volume-based average particle diameter Dv is small. Moreover, it is preferable that the volume-based average particle diameter is 3 μm or greater to prevent deterioration of the developing and cleaning characteristic. When the volume-based average particle diameter Dv is less than 3 μm, the amount of fine toner particles which are uneasily developed tend to increase on the carrier or the surface of the developing sleeve 51. The increase causes insufficient contact or friction of other toner particles with the carrier or the developing sleeve 51 and the oppositely charged toner particles to increase, to generate a defect image such as an image having togging.

A particle diameter dispersion indicated by a ratio (Dv/Dn) of a volume-based average particle diameter Dv and a number-based average particle diameter Dn can be from approximately 1.05 to approximately 1.40. By narrowing the particle diameter dispersion, a charging distribution of the toner becomes uniform. When the dispersion exceeds 1.40, the charging distribution of the toner becomes wide and the oppositely charged toner particles increase. Therefore, dust of the toner accumulating between thin lines of the toner image and fog appearing over the background image increase, resulting in deterioration in image quality. That is, it is difficult to obtain a high-quality image. When dispersion is less than 1.05, it is difficult to manufacture such toner. The particle diameter (i.e., volume average particle diameter or number average particle diameter) of a toner particle can be measured with a particle diameter measuring instrument such as COULTER COUNTER MULTISIZER, manufactured by COULTER ELECTRONICS, INC., by selectively using 50 μm apertures for the measuring holes to cooperate with the toner particle diameter to the measured, and taking an average of 50,000 toner particles.

Preferably, a shape factor "SF-1" of the toner is from approximately 100 to approximately 180, and the shape factor "SF-2" of the toner is in a range from approximately 100 to approximately 180.

Figure 22A:
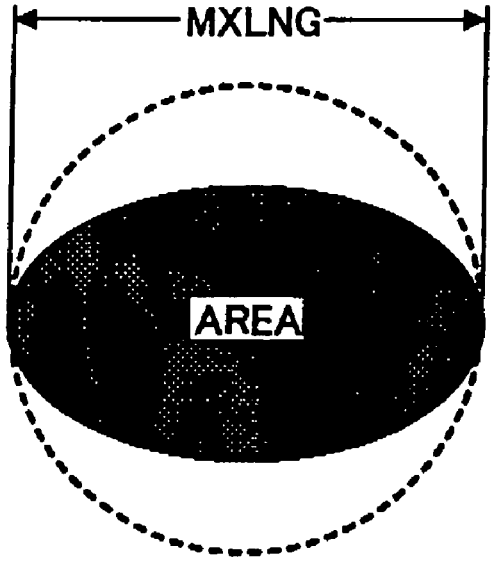
FIG. 22A illustrates a toner having an "SF-1" shape factor and FIG. 22B illustrates a toner having an "SF-2" shape factor.
Figure 22B:
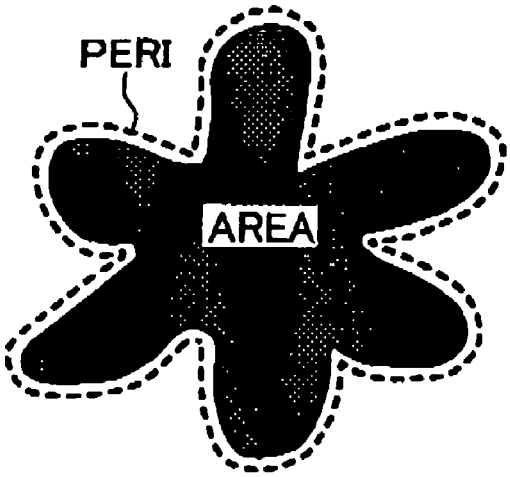

FIGS. 22A and 22B are diagrams showing toner shape factors SF-1 and SF-2.

The shape factor "SF1" of a particle is calculated by following Equation 2:

$$SF\text{-}1=\{(MXLNG)^2/\mathrm{AREA}\}\times(100\pi/4),$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF1" is 100, the particle has a perfect spherical shape. As the value of the "SF1" increases, the shape of the particle becomes more elliptical.

The shape factor "SF2" is a value representing irregularity (i.e., a ratio of convex and concave portions) of the shape of the toner. The shape factor "SF2" of a particle is calculated by following Equation 3:

$$SF\text{-}2=\{\{PERI)^2/\mathrm{AREA}\}\times(100\pi/4),$$

where "PERI" represents the perimeter of a figure obtained by projecting a toner particle on a two dimensional plane.

When the value of the shape factor "SF2" is 100, the surface of the toner is even (i.e., no convex and concave portions). As the value of the "SF2" increases, the surface of the toner becomes uneven (i.e., the number of convex and concave portions increase).

In this embodiment, toner images are sampled by using a field emission type scanning electron microscope such as (FE-SEM) S-800 manufactured by HITACHI, LTD. The toner image information is analyzed by using an image analyzer such as (LUSEX3) manufactured by NIREKO, LTD.

The toner particles preferably have the shape factor SF-1 from 100 to 180 and the shape factor SF2 from 100 to 180. When the shape of the toner particles is closer to the spherical shape, the contact of the toner particle with other toner particles on the photoconductive element 3 is a point contact, which improves the fluidity of the toner. Thus, the mutual adhesion of toner particles weakens and the fluidity is improved, thereby improving the transfer efficiency and facilitating the cleaning of the residual toner on the photoconductive element 3.

Therefore, the shape factors SF1 and SF2 are preferably 100 or greater. Furthermore, as the shape factors SF1 and SF2 increase, the toner particle shape becomes indefinite, the charging distribution of the toner widens, the development is no longer accurate with respect to the electrostatic latent image, and the transfer is no longer accurate with respect to the transfer electric field, thereby deteriorating the image quality. In addition, the transfer efficiency deteriorates and the residual amount of toner after the transfer increases, thereby requiring a large cleaning module 6, which is undesirable from the point of view of designing the image forming apparatus 100. For this reason, the shape factors SF1 and SF2 preferably do not exceed 180.

Figure 23A:
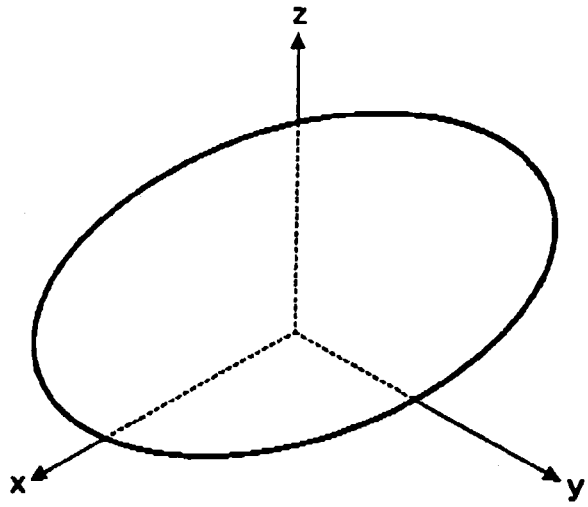
FIG. 23A illustrates an outer shape of the toner used in the image forming apparatus of FIG. 1, FIGS. 23B and 23C are schematic cross sectional views of the toner, showing major and minor axes and a thickness of FIG. 23A.
Figure 23B:
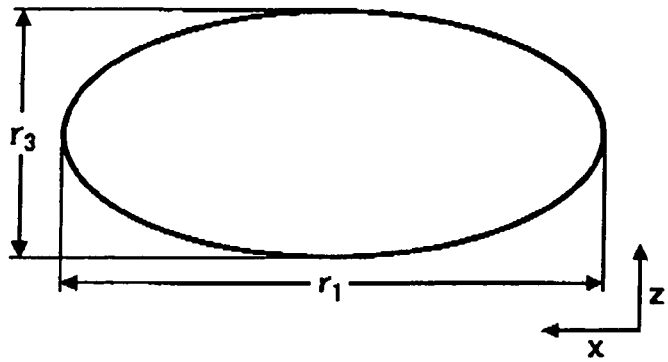
Figure 23C:
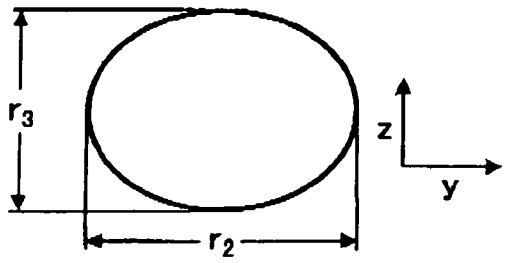

Further, the toner particles used in the image forming apparatus 100 may be substantially spherical in shape and can be expressed in terms of the following shape regulation. FIGS. 23A, 23B, and 23C show sizes of the toner. An axis x of FIG. 23A represents a major axis r1 of FIG. 23B, which is the longest axis of the toner. An axis y of FIG. 23A represents a minor axis r2 of FIG. 23C, which is the second longest axis of the toner. The axis z of FIG. 23A represents a thickness r3 of FIGS. 23B and 23C, which is a thickness of the shortest axis of the toner. The toner has a relationship between the major and minor axes r1 and r2 and the thickness r3 as follows:

$$r1 \geqq r2 \geqq r3.$$

The toner of FIG. 23A is preferably in a spindle shape in which the ratio (r2/r1) of the major axis r1 to the minor axis r2 is from approximately 0.5 to approximately 1.0, and the ratio (r3/r2) of the thickness r3 to the minor axis is from approximately 0.7 to approximately 1.0. The lengths showing with r1, r2 and r3 can be monitored and measured with scanning electron microscope (SEM) by taking pictures from different angles.

When the ratio (r2/r1) is less than approximately 0.5, the charging distribution widens because the toner particle shape becomes more indefinite. Moreover, when the ratio (r3/r2) is less than approximately 0.7, the charging distribution of toner particles widens because the toner particle shape becomes more indefinite. Particularly, when the ratio (r3/r2) is 1.0, the charging distribution of the toner particles becomes narrow because the toner particle shape becomes approximately spherical. The toner particle size was measured by a scanning electron microscope (SEM) by taking pictures by observing and changing an angle of field of vision.

The toner particle shape can be controlled by the manufacturing method. For example, when the toner is manufactured by dry grinding, the surface of the toner particles is uneven and the toner particle shape is indefinite. However, even the toner manufactured by the dry grinding can be formed by adjusting a thermal or mechanical process which shapes the toner particles into approximately spherical shapes which are close to true spherical shapes. The toner particles manufactured by forming droplets by suspension polymerization method or emulsion polymerization method have a smooth surface and an approximately spherical shape close to a true spherical shape. In addition, the toner particles can be made rugby ball shaped by applying a shearing force by strongly agitating the toner particles during a reaction process without a solvent.

A toner having a substantially spherical shape is preferably prepared by a method in which a toner composition including a polyester prepolymer having a function group including a nitrogen atom, a polyester, a colorant, and a releasing agent is subjected to an elongation reaction and/or a crosslinking reaction in an aqueous medium in the presence of fine resin particles.

Toner constituents and a preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio {[OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate; is aromatic diisocyanate such as tolylenediisocyanate, diphenylmethene diisocyanate; aroma-aliphatic diisocyanate such as α,α,α',α',-tetramethylxylene diisocynate; isocynates; the above-mentioned isocyanats blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetxabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the cross-linking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus 100, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 5/95 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of heat conserving resistance and low temperature fixability of the toner.

The toner binder preferably has a glass transition temperature (Tg) of from 45° C. to 65° C., and preferably from 45° C. to 60° C. When the glass transition temperature is less than 45° C., the heat conserving resistance of the toner deteriorates. When the glass transition temperature is higher than 65° C., the low temperature fixability deteriorates.

Since the urea-modified polyester can exist on the surfaces of the mother toner particles, the toner of-the present invention has better heat conserving resistance than conventional toners including a polyester resin as a binder resin even though the glass transition temperature is low.

A colorant, a charge control agent, and a releasing agent can be selected from existing materials.

The method for manufacturing the toner is described. The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. Preferably, the amount of the organic solvent to be used should is from 0 parts by weight to 300 parts by weight for 100 parts by weight of polyester prepolymer, more preferably from 0 parts by weight to 100 parts by weight for 100 parts by weight of polyester prepolymer, and even more preferably from 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl, carboxylic acids having from 2 to 10 carbon atoms and their metal salts, disodium perfluorooctanesulfonylglutamate, sodium 3-(omega-fluoroalkyl(C6-C11)oxy)-1-alkyl(C3-C4) sulfonate, sodium, 3-1 omega-fluoroalkanoyl (C6-(C8)-N-ethylamino}-1-propanesulfonate, fluoroalkyl (C11-C20) carboxylic acids and their metal salts, perfluoroalkylcarboxylic acids and their metal salts, perfluoroalkyl (C4-C12)sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl(C6-C10)-N-ethylsulfonylglycin, monoperfluoroalkyl(C6-C16)e-thylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl (C6-C10) sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORAD® FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

The fine particles of resin are added to stabilize the host particles of toner that are formed in the aqueous medium. Therefore, it is desirable that the fine particles of resin are added to make 10 to 90 percent covering on the surface of the host particles of the toner.

Specific examples of the particulate polymers include particulate polymethyl methacrylate having a particle diameter between approximately 1 μm and approximately 3 μm, particulate polystyrene having a particle diameter between approximately 0.5 μm and approximately 2 μm, particulate styrene-acrylonitrile copolymers having a particle diameter of approximately 1 μm, PB-200H (manufactured by KAO CORP.), SGP (manufactured by SOKEN CHEMICAL & ENGINEERING CO., LTD.), TECHNOPOLYMER SE (manufactured by SEKISUI PLASTICS CO., LTD.), SPG-3G (manufactured by SOKEN CHEMICAL & ENGINEERING CO., LTD.), and MICROPEARL (manufactured by SEKISUI FINE CHEMICAL CO., LTD.).

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in, water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers, can be used. Among them, the high speed shearing type dispersion methods are preferable for preparing a dispersion including grains with a grain size from approximately 2 μm to approximately 20 μm. The number of rotations of the high speed shearing type dispersers is not particularly limited, but is usually from approximately 1,000 rpm (revolutions per minute) to approximately 30,000 rpm, and preferably from approximately 5,000 rpm to approximately 20,000 rpm. While the dispersion time is not limited, it is usually from approximately 0.1 minute to approximately 5 minutes for the batch system. The dispersion temperature is usually from a temperature of approximately 0° C. to approximately 150° C., and preferably from approximately 40° C. to approximately 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from approximately 0° C. to approximately 150° C., and preferably from approximately 40° C. to approximately 98° C. In addition, a known catalyst such as dibutyltinlaurate and dibutyltinlaurate can be used. The amines (B) are used as the elongation agent and/or crosslinker.

After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge control agent is penetrated into the mother toner particles, and inorganic fine particles such as silica, titanium oxide etc. are added externally thereto to obtain the toner of the present invention.

When preparing the toner by mixing the mother toner particles with an external additive and the lubricant, the external additive and the lubricant may be added individually or at the same time. The mixing operation of the external additive and the lubricant with the mother toner particles can be carried out using a conventional mixer, which preferably includes a jacket to control the inner temperature of the mixer. Suitable mixers are V-type mixers, rocking mixers, Ledige mixers, nauter mixers and Henschel mixers. Preferably, the rotational speed, mixing time and/or mixing temperature are optimized to prevent embedding of the external additive into the mother toner particles and forming a thin layer on the surface of the lubricant.

Thus, a toner having a small particle size and a sharp particle distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

Inorganic fine particles may be used as an external additive to assist the fluidity, the developing and the charging of the toner particles. Hydrophobic silica and/or hydrophobic titanium oxide fine particles are particularly desirable for use as the inorganic particles. The inorganic particulate material preferably has a primary particle diameter of from $5\times10^{-3}$ μm to 2 μm, and more preferably from $5\times10^{-3}$ μm to 0.5 μm. In addition, a specific surface area of the inorganic particulates measured by a BET method is preferably from 20 $m^2/g$ to 500 $m^2/g$. The content of the external additive is preferably from 0.01% by weight to 5% by weight, and more preferably from 0.01% by weight to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting' agent, it is preferable to use hydrophobic silica fine grains and hydrophobic titanium oxide fine grains in combination.

The external additive is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

The thus prepared toner is mixed with a magnetic carrier to be used as a two-component developer. In this case, the toner is included in the two-component developer in an amount of from 1 part to 10 parts by weight per 100 parts by weight of the carrier. As an alternative, the toner of the present invention can be used as a one-component magnetic or nonmagnetic developer.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. A process cartridge detachably attached to an image forming apparatus, comprising:

a first body member;

a second body member including an engaging part, the second body member engaged with the first body member by the engaging part and configured to be pivoted between an open position and a closed position;

an image bearing member detachably disposed in the first body member and configured to bear an image on a surface thereof; and a plurality of detachable units including a cleaning mechanism, the cleaning mechanism detachably disposed in the second body member adjacent at least a second detachable unit, arranged around the image bearing member to face the image bearing member, and configured to clean the surface of the image bearing member.

2. The process cartridge according to claim 1, wherein:

the first body member includes a bottom surface and is placed on a horizontal plane such that the bottom surface is held in contact with a surface of the horizontal plane; and the second body member includes an external surface and has a rotation angle more than or equal to 90 degrees such that the external surface is moved to the open position to be held in contact with the surface of the horizontal plane.

3. The process cartridge according to claim 1, wherein:

(a) the cleaning mechanism comprises, at least one cleaning unit configured to remove a toner on the surface of the image bearing member, and at least one auxiliary unit configured to cooperate with the at least one cleaning unit with respect to the image bearing member; and (b) the at least one cleaning unit and the at least one auxiliary unit are detachably disposed in the second body member.

4. The process cartridge according to claim 3, wherein:

the first body member includes a bottom surface and is placed on a horizontal plane such that the bottom surface is held in contact with a surface of the horizontal plane;

the second body member includes an external surface and the external surface is pivotably moved between the open position and the closed position; and the at least one cleaning unit and the at least one auxiliary unit are visible from a top of the second body member when the external surface of the second body member is pivotably moved to the open position to be held in contact with the surface of the horizontal plane.

5. The process cartridge according to claim 4, wherein:

the cleaning unit is disposed at a position above the at least one auxiliary unit; and the engaging part pivotably engages the second body member with the first body member at a portion lower than a moving portion of the second body member so that the second body member opens upward when the second body member is pivotably opened to separate from the first body member.

6. The process cartridge according to claim 3, wherein:

at least one of (a) the cleaning units or (b) the at least one auxiliary units is configured to be removed in a substantially vertical direction via an open space provided on the external surface of the second body member when the second body member is in the closed position with respect to the first body member.

7. The process cartridge according to claim 6, wherein:

the external surface of the second body member includes a lid.

8. The process cartridge according to claim 3, wherein:

the at least one cleaning unit and the at least one auxiliary unit include at least two rotating members; and the second body member includes side plates so that one end of the axes of at least two rotating members is held in common at each of the side plates detachably disposed in the second body member and is removed with the side plates from the second body member.

9. The process cartridge according to claim 1, further comprising:

a third body member detachably engaged with the first body member; and a developing mechanism configured to develop a toner image based on the image and, including a developer carrying member configured to carry a developer on a surface thereof; and a positioning member detachable with respect to the first and third body members, and configured to perform a positioning between the first and third body members and between the image bearing member and the developer carrying member of the developing mechanism.

10. The process cartridge according to claim 1, wherein:

the facing mechanism includes a charging mechanism detachably disposed in the first body member and configured to uniformly charge the surface of the image bearing member.

11. The process cartridge according to claim 1, wherein:

the toner has an average circularity from approximately 0.93 to approximately 1.00.

12. The process cartridge according to claim 11, wherein:

the toner has a ratio of volume average particle size to a number average particle size from approximately 1.05 to approximately 1.40.

13. The process cartridge according to claim 11, wherein:

the toner includes particles having a spindle outer shape, a ratio of a major axis r1 to a minor axis r2 from approximately 0.5 to approximately 1.0, and a ratio of a thickness r3 to the minor axis r2 from approximately 0.7 to approximately 1.0; and $$r1 \geqq r2 \geqq r3.$$

14. The process cartridge according to claim 11, wherein:

the toner is obtained from at least one of an elongation and a crosslinking reaction of toner composition comprising a polyester prepolymer having a function group including a nitrogen atom, a polyester, a colorant, and a releasing agent in an aqueous medium under resin fine particles.

15. A process cartridge detachably attached to an image forming apparatus, comprising:

a first body member;

a second body member including an engaging part, the second body member engaged with the first body member by the engaging part and configured to be pivoted between an open position and a closed position;

an image bearing member detachably disposed in the first body member and configured to bear an image on a surface thereof; and a facing mechanism detachably disposed in the second body member, and arranged around the image bearing member to face the image bearing member;

wherein:

the facing mechanism includes a plurality of internal facing mechanisms;

at least one of the plurality of internal facing mechanisms is configured to be removed when the external surface of the second body member is pivotably moved with respect to the first body member to the open position; and at least one of the other plurality of internal facing mechanisms is configured to be removed via an open space provided on an external surface of the second body member when the second body member is in the closed position with respect to the first body member.

16. A process cartridge detachably attached to an image forming apparatus, comprising:

a first body member;

a second body member comprising an engaging part, the second body member engaged with the first body member by the engaging part and is configured to be pivoted between an open position and a closed position;

an image bearing member detachably disposed in the first body member and configured to bear an image on a surface thereof; and a facing mechanism detachably disposed in the second body member, and arranged around the image bearing member to face the image bearing member;

wherein:

the facing mechanism includes a plurality of rotating members functioning as a plurality of facing mechanisms; and the second body member includes side plates so that one end of the axes of the plurality of rotating members is held in common at each of the side plates detachably disposed in the second body member, and is removed with the side plates from the second body member.

17. A process cartridge detachably attached to an image forming apparatus, comprising:

first and second body members;

means for bearing an image on a surface thereof;

a plurality of detachable means for facing the means for bearing an image; and means for opening and closing a space, the means for bearing an image and the plurality of detachable means for facing disposed in the means for opening and closing;

wherein the plurality of detachable means for facing includes means for cleaning the surface of the means for bearing, the means for cleaning disposed in the second body member adjacent at least a second detachable means for facing, and arranged around the means for bearing to face the means for bearing.

18. The process cartridge according to claim 17, wherein:

the plurality of detachable means for facing are internal to the process cartridge;

at least one of the plurality of detachable means for facing is removed when the means for opening and closing is in an open position; and at least one of the other plurality of detachable means for facing is removed via an open space when the means for opening and closing is in a closed position.

19. The process cartridge according to claim 17, wherein:

the plurality of means for facing includes a plurality of means for rotating each having an end of axes;

the means for opening and closing holds the respective end of axes of the plurality of means for rotating in common at each of side plates detachably disposed to the means for opening and closing; and the plurality of means for rotating are removed with the side plates from the means for opening and closing.

20. A method of removing facing mechanisms of an image forming apparatus, comprising:

keeping first and second body members engaged with each other using an engaging part to form a closed position, the second body member having an image bearing member detachably disposed therein;

opening a lid provided on a top of the second body member over a cleaning mechanism;

removing a first unit from the cleaning mechanism via an open space formed by opening the lid; and removing a second unit from the cleaning mechanism via the open space, the second unit disposed at a position lower than the first unit.

21. The method according to claim 20, further comprising:

turning the second body member around the engaging part to form an open position; and independently removing rotating members in a substantially vertical direction.

22. The method according to claim 20, further comprising:

turning the second body member around the engaging part to form an open position; and removing rotating members together with positioning members in a substantially vertical direction.

23. An image forming apparatus, comprising:

a first body member;

a second body member including an engaging part, the second body member engaged with the first body member by the engaging part and configured to be pivoted between an open position and a closed position;

an image bearing member detachably disposed in the first body member and configured to bear an image on a surface thereof; and a plurality of detachable units including a cleaning mechanism, the cleaning mechanism detachably disposed in the second body member adjacent at least a second detachable unit, arranged around the image bearing member to face the image bearing member, and configured to clean the surface of the image bearing member.

24. An image forming apparatus, comprising:

frame;

a first body member;

a second body member comprising an engaging part, the second body member engaged with the first body member by the engaging part and is configured to be pivoted between an open position and a closed position;

an image bearing member detachably disposed in the first body member and configured to bear an image on a surface thereof; and a facing mechanism detachably disposed in the second body member, and arranged around the image bearing member to face the image bearing member;

wherein:

the facing mechanism includes a plurality of internal facing mechanisms;

at least one of the plurality of internal facing mechanisms is configured to be removed when the external surface of the second body member is pivotably moved with respect to the first body member to the open position; and at least one of the other plurality of internal facing mechanisms is configured to be removed via an open space provided on an external surface of the second body member when the second body member is in the closed position with respect to the first body member.

25. An image forming apparatus, comprising:

a first body member;

a second body member comprising an engaging part, the second body member engaged with the first body member by the engaging part and is configured to be pivoted between an open position and a closed position;

an image bearing member detachably disposed in the first body member and configured to bear an image on a surface thereof; and a facing mechanism detachably disposed in the second body member, and arranged around the image bearing member to face the image bearing member;

wherein:

the facing mechanism includes a plurality of rotating members functioning as a plurality of facing mechanisms; and the second body member includes side plates so that one end of the axes of the plurality of rotating members is held in common at each of the side plates detachably disposed in the second body member, and is removed with the side plates from the second body member.

26. An image forming apparatus, comprising:

first and second body members;

means for bearing an image on a surface thereof;

a plurality of detachable means for facing the means for bearing an image; and p1 means for opening and closing a space, the means for bearing an image and the plurality of detachable means for facing disposed in the means for opening and closing;

wherein the plurality of detachable means for facing includes means for cleaning the surface of the means for bearing, the means for cleaning disposed in the second body member adjacent at least a second detachable means for facing, and arranged around the means for bearing to face the means for bearing.

27. The image forming apparatus according to claim 26, wherein:

the plurality of detachable means for facing are internal to the second body member;

at least one of the plurality of detachable means for facing is removed when the means for opening and closing is in an open position; and at least one of the other plurality of detachable means for facing is removed via an open space when the means for opening and closing is in a closed position.

28. The image forming apparatus according to claim 26, wherein:

the plurality of means for facing includes a plurality of means for rotating each having an end of axes;

the means for opening and closing holds the respective end of axes of the plurality of means for rotating in common at each of side plates detachably disposed to the means for opening and closing; and the plurality of means for rotating are removed with the side plates from the means for opening and closing.

* * * * *